US007188444B2

(12) United States Patent
Danner et al.

(10) Patent No.: US 7,188,444 B2
(45) Date of Patent: Mar. 13, 2007

(54) FIREARM ORIENTATION AND DROP SENSOR SYSTEM

(75) Inventors: Dale R. Danner, Eastview, KY (US); David O. Matteson, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 10/878,216

(22) Filed: Jun. 28, 2004

(65) Prior Publication Data

US 2006/0277808 A1 Dec. 14, 2006

Related U.S. Application Data

(62) Division of application No. 10/152,916, filed on May 22, 2002, now Pat. No. 6,785,996.

(60) Provisional application No. 60/293,394, filed on May 24, 2001.

(51) Int. Cl.
*F41A 17/12* (2006.01)

(52) U.S. Cl. ..... 42/70.09; 42/70.08

(58) Field of Classification Search ..... 42/70.08, 42/70.09

See application file for complete search history.

(56) References Cited

U.S. PATENT DOCUMENTS

| | | | | |
|---|---|---|---|---|
| 337,872 | A | 3/1886 | Russel | |
| 953,279 | A | 3/1910 | Moore | |
| 2,279,692 | A | 4/1942 | Marten-Gwilliam | |
| 2,780,882 | A | 2/1957 | Temple | |
| 2,957,391 | A | 10/1960 | Lovercheck | |
| 3,250,034 | A | 5/1966 | Simmons | |
| 3,255,547 | A | 6/1966 | Gregory et al. | |
| 3,299,812 | A | 1/1967 | Suh et al. | |
| 3,495,349 | A | 2/1970 | Thompson | |
| 3,613,282 | A | 10/1971 | Ramsay | |
| 3,650,174 | A | 3/1972 | Nelsen | |
| 3,736,837 | A | 6/1973 | Kaprelian et al. | |
| 3,783,788 | A | 1/1974 | Hayashi | |
| 3,814,017 | A | 6/1974 | Backstein et al. | |
| 3,886,793 | A | 6/1975 | Cramer et al. | |
| 4,134,223 | A | 1/1979 | Hillenbrandt et al. | |
| 4,275,521 | A | 6/1981 | Gerstenberger et al. | |
| 4,287,394 | A | 9/1981 | Hargita et al. | |
| 4,324,060 | A | 4/1982 | Lawrence | |
| 4,329,803 | A | 5/1982 | Johnson et al. | |
| 4,332,098 | A | 6/1982 | Estenevy | |
| 4,347,679 | A | 9/1982 | Grunig et al. | |
| 4,414,476 | A * | 11/1983 | Maddox et al. | 250/559.37 |

(Continued)

FOREIGN PATENT DOCUMENTS

| | | |
|---|---|---|
| DE | 28 37 738 | 8/1978 |

(Continued)

OTHER PUBLICATIONS

G. Sitton, "Voer VEC 91 Rifle", Petersen's Hunting, Feb. 1993.

*Primary Examiner*—Stephen M. Johnson
(74) *Attorney, Agent, or Firm*—Womble Carlyle Sandridge & Rice, PLLC

(57) ABSTRACT

A sensor system for detecting jarring, acceleration or other application of force to a firearm, and/or movement of the firearm into an undesired orientation, which includes a sensor array mounted to a firearm. The sensor array detects the excessive acceleration and/or movement of the firearm into certain orientations and generates a sensor signal indicative of a fault condition. In response, a control system blocks or interrupts the firing sequence of the firearm to prevent inadvertent discharge of a round of ammunition by the firearm.

24 Claims, 16 Drawing Sheets

U.S. PATENT DOCUMENTS 4,510,844 A 4/1985 Fritz et al.
4,563,828 A * 1/1986 Kriegeskorte ..... 42/84
4,727,670 A 3/1988 Krouse
4,793,085 A 12/1988 Surawski et al.
4,825,765 A 5/1989 Ochi et al.
4,944,224 A 7/1990 Fiedler et al.
4,956,029 A 9/1990 Hagel et al.
4,960,033 A 10/1990 Quantz
4,970,819 A 11/1990 Mayhak
5,031,536 A 7/1991 Barker et al.
5,062,232 A 11/1991 Eppler
5,083,392 A 1/1992 Bookstaber
5,113,745 A 5/1992 Allen
5,138,946 A 8/1992 Soltz et al.
5,192,818 A 3/1993 Martin
5,204,490 A 4/1993 Soltz et al.
5,206,455 A 4/1993 Williams et al.
5,245,909 A * 9/1993 Corrigan et al. ..... 89/41.19
5,272,828 A 12/1993 Petrick et al.
5,301,448 A 4/1994 Petrick et al.
5,303,495 A 4/1994 Harthcock
5,329,840 A 7/1994 Corney
5,351,597 A 10/1994 Holmstrom et al.
5,392,688 A 2/1995 Boutet et al.
5,461,812 A 10/1995 Bennett
5,485,786 A 1/1996 Hesse et al.
5,493,392 A * 2/1996 Blackmon et al. ..... 356/139.03
5,508,683 A 4/1996 Hall
5,537,771 A * 7/1996 Martin ..... 42/70.01
5,546,690 A 8/1996 Ciluffo
5,564,211 A * 10/1996 Mossberg et al. ..... 42/70.11
5,608,982 A 3/1997 Bouvard et al.
5,625,972 A 5/1997 King et al.
5,631,437 A * 5/1997 LaVigna et al. ..... 89/14.3
5,640,026 A 6/1997 Terazono
5,704,151 A 1/1998 West et al.
5,715,623 A 2/1998 Mackay, III
5,755,056 A * 5/1998 Danner et al. ..... 42/84
5,799,433 A 9/1998 Danner et al.
5,824,942 A * 10/1998 Mladjan et al. ..... 89/41.17
5,897,611 A * 4/1999 Case et al. ..... 702/150
6,219,952 B1 4/2001 Mossberg et al.
6,260,300 B1 7/2001 Klebes
6,286,241 B1 9/2001 Constant et al.
6,286,242 B1 9/2001 Klebes
6,321,478 B1 11/2001 Klebes
6,429,769 B1 8/2002 Fulgueira
6,499,382 B1 12/2002 Lougheed et al.
6,785,996 B2 9/2004 Danner et al.
2002/0170219 A1* 11/2002 Martin ..... 42/70.06

FOREIGN PATENT DOCUMENTS

DE 35 16 202 A1 6/1986
FR 2 699 658 A1 12/1992
GB 2 072 811 A 10/1991

* cited by examiner

FIREARM ORIENTATION AND DROP SENSOR SYSTEM

CROSS REFERENCE TO RELATED APPLICATION

The present application is a divisional application of U.S. patent application Ser. No. 10/152,916, filed on May 22, 2002, now U.S. Pat. No. 6,785,996, and claims the benefit of the priority of U.S. Provisional Application Ser. No. 60/293,394, filed May 24, 2001.

FIELD OF THE INVENTION

The present invention relates to the control and actuation of a firing sequence of a firearm. In particular, the present invention relates to a sensor system for monitoring and sensing application of a jarring event or acceleration and/or the movement of a firearm into an undesired orientation, and blocking the firing sequence of the firearm to prevent an inadvertent discharge of the firearm.

BACKGROUND OF THE INVENTION

Inadvertent discharge of firearms is one of the leading causes of accidental injuries and deaths involving firearms. When a firearm is dropped or experiences the application of a force or other jarring event, the application of such force to the firearm can cause the firearm to inadvertently discharge either by causing the release of the firing pin in a percussion firing system in which the firing pin strikes and thus initiates firing of a round of ammunition within the chamber of a firearm, or, in the case of an electrically actuated firearm, causes an inadvertent trigger signal to be sent to the firearm control system in response to which an electric firing pulse is transmitted to the round of ammunition. In addition, there are times when a firearm is placed in an unsafe orientation or position and its trigger is inadvertently engaged, resulting in an inadvertent or undesired discharge of the firearm. For example, if the firearm is rotated upside down or canted at an angle of more than 45 degrees, such conditions generally are considered unsafe for the discharge of the firearm.

It is important, therefore, to be able to detect when a firearm is subjected to a jarring event and/or undesired movement, such as undue acceleration or being moved into an undesirable or unsafe orientation, and prevent the inadvertent or undesired discharge of the firearm, but without unduly interfering with the normal operation of the firearm and preventing its safe, authorized use.

SUMMARY OF THE INVENTION

Briefly described, the present invention relates to a sensor system for sensing firearm orientation and/or jarring events and preventing the firearm from being fired in an unsafe condition. The system includes one or more sensor arrays, having one or more sensors for sensing jarring events or acceleration and/or for determining the orientation of the firearm, mounted to a firearm at desired locations along or within the frame or stock of the firearm, and a control system to process the sensor signals and interrupt a firing sequence of the firearm when appropriate. The system detects acceleration from drops or other jarring events that can be distinguished from normal, safe handling of the firearm, which generally will only introduce a limited amount of acceleration that is significantly below the acceleration typically associated with accidental discharge from jar events. In addition, or alternatively, the system can have the capability of monitoring or sensing changes in firearm orientation(s) to orientations of a firearm that are undesirable or unsafe and that typically would not be used, such as, for example, the firearm being turned upside-down and when the angle or cant of the firearm with respect to one or more predetermined axes or orientation of the firearm passes some threshold value.

In one embodiment, the firing of a firearm will be prevented if excessive jarring or acceleration and/or improper orientation of the firearm are sensed. For purposes of this specification, the term "acceleration" should be construed as to include de-acceleration or negative acceleration as well as positive acceleration. In this embodiment, the firearm sensor system generally is omni-directional, so as to be capable of sensing a jarring event, or other application of force, in any direction, although it may be advantageous to have the sensor system have greater sensitivity in certain directions than others. The firearm sensor system will include one or more inertia switches or acceleration switches configured in a sensor array mounted on a mounting block attached to the firearm to create an omni-directional jar or acceleration sensor. The switches used generally are uni-directional so as to be affected by inertia in only one direction.

Typically, at least four to six uni-directional inertia or acceleration switches are mounted in the array in order to obtain an omni-directional sensor system. It will also be understood that in other systems or applications, as few as a single sensor can be used. Other force or acceleration sensors also can be used, including an accelerometer or system of accelerometers, piezoelectric shock sensors, electrolytic tilt sensors and other acceleration sensors. In addition, it would also be possible to provide a mass suspended from a cantilevered beam that is gauged such as with a strain gauge and use the strain gauge to sense a jarring event. In short, any sensor that can be made to sense acceleration is a possible sensor for stopping the firing sequence of the firearm in event of a jarring or unauthorized force application or unnecessary rapid acceleration. As the firearm is subjected to a jarring event or accelerated above a certain sensor limit or threshold, a sensor signal is generated to indicate a fault condition, in response to which the control system will block the firing sequence and prohibit the firearm from firing.

The sensor system further generally will be capable of measuring or sensing the orientation of the firearm along two or more axes of angle measurement relative to the earth. The first axis of measurement generally is inclination or elevation. The second axis of angle measurement generally measures rotation of the firearm about its bore. The sensor system for obtaining these orientation measurements generally includes an orientation sensor, such as a three-axis magnetometer. However, any sensor or array of sensors that can determine the gun's orientation with respect to a reference or threshold is capable of being used, including, for example, tilt or tip-over switches, inclinometers, accelerometers, and gyros or other types of sensors that can be used to sense or monitor firearm orientation can be used in the present invention. The sensors monitor and generate sensor signal(s) indicating the orientation of the firearm with respect to the predetermined axes, which sensor signal is communicated to the control system. The control system will process the sensor signal(s) to determine if the firearm is in an acceptable firing orientation. If the orientation is determined to be improper or unacceptable, the control system will issue an interrupt signal that will stop the firing sequence if the trigger is pulled.

Though in a preferred embodiment a firearm is kept from firing if it has experienced a jar situation and/or is in an improper orientation, the system does not need to do both. It is possible that a system of sensors could be used to sense only acceleration or a jar event, or the movement of the firearm to an undesired orientation alone to keep the firearm from firing.

The control system of the firearm sensor system further generally will communicate with a fire control, trigger system and/or a safety system for the firearm. The control system can include a separate control system mounted within the frame, stock, receiver or other portion of the firearm, or can be included as part of a firearm control system of an electronic firearm such as disclosed in U.S. Pat. No. 5,755,056, the disclosure of which is incorporated herein by reference. The control system blocks or permits the firing sequence to proceed depending on a sensor output signal.

The halting of the firing sequence is accomplished in firearms that are electrically initiated by the control system issuing an interrupt signal to stop the transmission of a firing pulse to a round of electrically activated ammunition. The sensor system of the present invention also could be applied to a conventional percussion firearm as well, such as by controlling a solenoid-activated stop to hold a firing pin in a ready to fire position and block a percussion type fire control from imparting or releasing its energy to a round of percussion ammunition to initiate a firing sequence.

Various objects, features, and advantages of the present invention will become apparent to those skilled in the art upon a review of this specification when taken in conjunction with the accompanying drawings.

DETAILED DESCRIPTION OF THE INVENTION

Figure 1A:
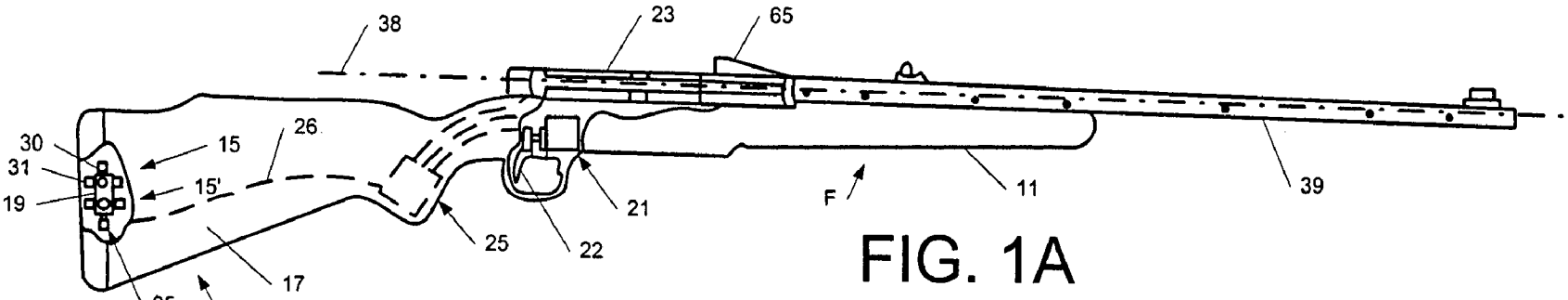
FIGS. 1A and 1B illustrate example applications of the firearm sensor system of the present invention as applied to a rifle and a handgun.
Figure 1B:
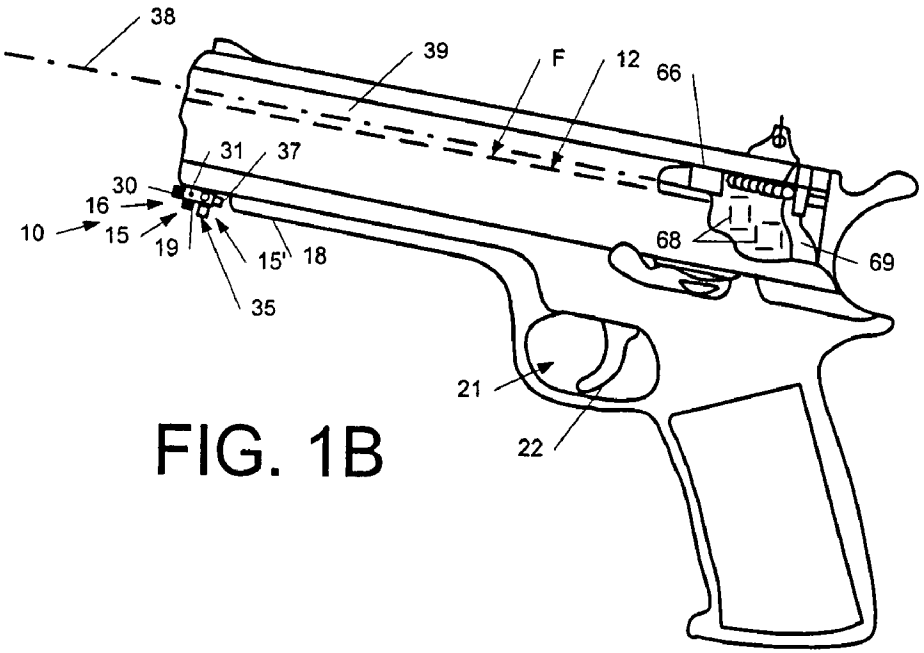
Figure 1C:
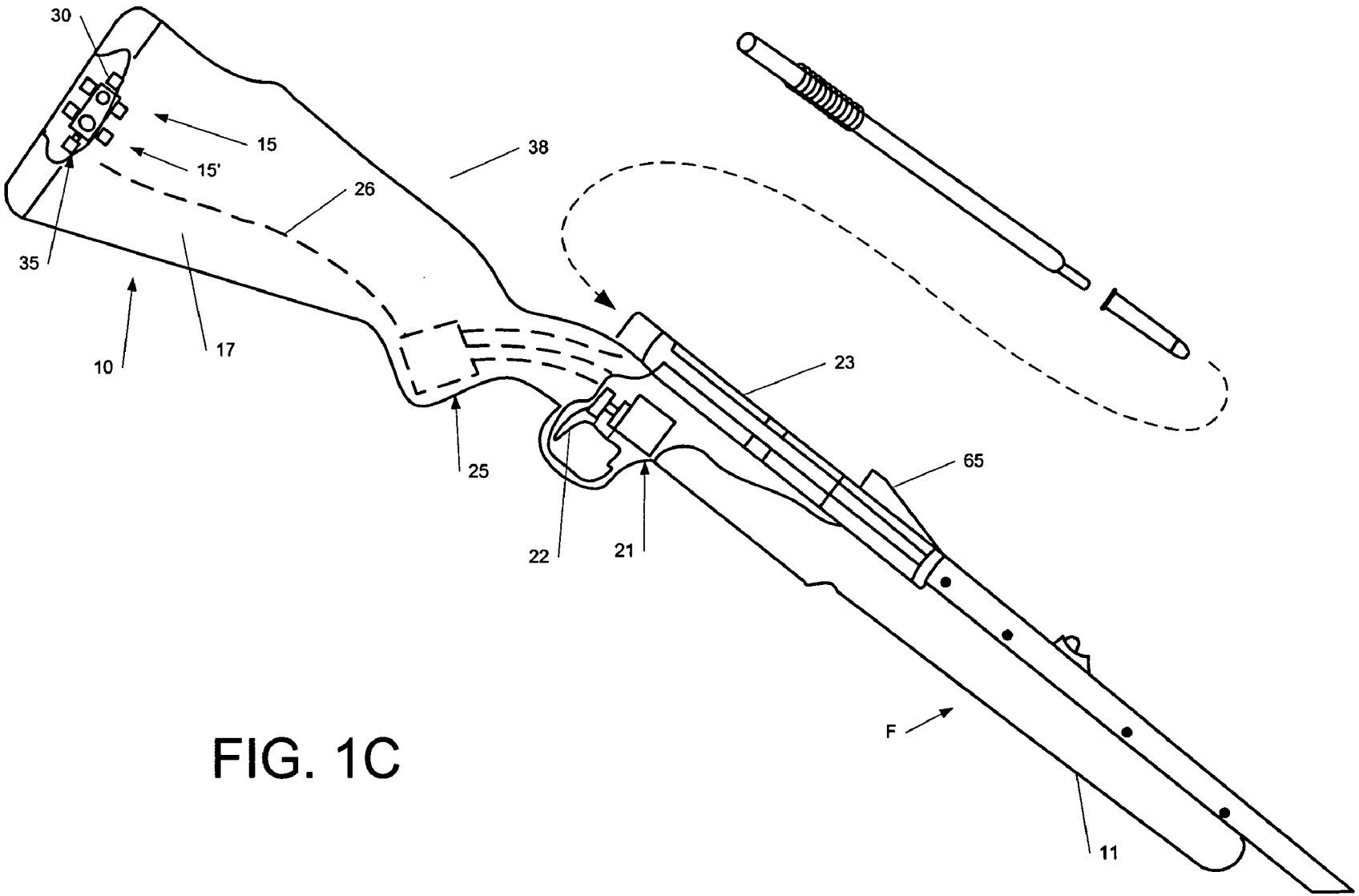
FIG. 1C is a perspective illustration of the firearm sensor system of the present invention as applied to a rifle, and in which an electrically conductive or mechanical firing pin, firing pin spring, and a round of ammunition are shown.

Turning now to the drawings in which like numerals indicate like parts throughout the several views, the present invention relates to a firearm sensor system 10 for a firearm F for sensing a fault condition, such as the firearm experiencing a jarring event, application of force or undue acceleration, or for sensing movement of the firearm into an unsafe or undesired orientation, and preventing the firearm from being fired upon detection of such an unsafe or fault condition. As shown in FIGS. 1A and 1B, the firearm sensor system 10 can be used in any type of firearm, such as various types of rifles 11, as shown in FIG. 1A, shotguns, or other types of long guns; and/or handguns 12, as shown in FIG. 1B, such as semiautomatic pistols, revolvers, and other types of handguns. It also will be understood by those skilled in the art that the firearm sensor system of the present invention is not and should not be limited to use solely in one type of firearm, and can be used in both handheld, small arms types of firearms, as well as other types of firing systems.

The firearm sensor system 10 generally includes one or more sensor arrays 15 having one or more sensors 16 for sensing jarring events or application of force or undue acceleration of the firearm, and/or determining the orientation of the firearm. The sensor arrays 15 generally are mounted at a desired location or locations within the body of the firearm, typically within the stock 17 of a rifle as indicated in FIG. 1A, or along the frame 18 of a handgun 12 as indicated in FIG. 1B, or otherwise along the front stock, receiver, or grip of a firearm. Typically, the sensors 16 of the sensor arrays 15 are mounted to a mounting block 19 that generally is made from a rigid, durable, but lightweight material such as a plastic, although other types of materials also can be used.

As shown in FIGS. 2A–5, the sensors are mounted on the mounting block 19 in a variety of different configurations and using a variety of different sensors so as to form the sensor array or arrays 15. The mounting block 19 is in turn mounted to the firearm either internally within the stock, grip or frame of the firearm as indicated in FIG. 1A, or externally as indicated in FIG. 1B. The firearm further can include percussion or electronically operated firearms, such as disclosed in U.S. Pat. No. 5,755,056, and will include a fire control 21 (FIGS. 1A and 1B) including a trigger 22 and a percussion or electrically conductive firing pin 23. The sensor array 15 is in turn connected to a control system 25 (FIGS. 1A and 6B), which generally is mounted within the frame, receiver, or stock of the firearm, as indicated in FIG. 1A. The sensor array generally communicates with the control system via wires 26 (shown in dashed lines) to communicate the detection or sensing of a fault condition to the control system 25, which in turn takes action to halt or interrupt the progress of a firing sequence of the firearm.

A preferred embodiment of the firearm sensor system 10 would include both a drop/jar sensor system 27 (FIGS. 2A–2H, 6A and 6B) and an orientation sensor system 28 (FIGS. 3–5 and 6C). However, it will be understood by those skilled in the art that the use of both the orientation and drop/jar sensor systems together is not required in the use of the present invention. Thus, the present invention envisions the use of either the drop/jar sensor or orientation sensor systems, or both for controlling the operation of a firearm.

Both the drop/jar sensor system 27 (FIGS. 2A–2H) and orientation sensor system 28 (FIGS. 3–5), when used jointly, further typically will be incorporated into a common control system 25. Preferred embodiments of both the drop/jar 27 (FIGS. 2A–2D, 6A and 6C) and orientation sensor systems 28 (FIGS. 3–5, 6C and 6F) are described below.

In one embodiment, the firearm sensor system 10 includes drop/jar sensor system 27 (FIGS. 2A–2H) wherein the firing sequence of a firearm will be prevented or interrupted if it is detected that the firearm has been subjected to excessive jarring, application of force or being subjected to undue acceleration. Typically, acceleration from drops or other jarring or force application events can be distinguished from normal, safe handling of the firearm, that generally only introduces a limited amount of acceleration or application of force, which is typically significantly below the acceleration or force generally associated with a jarring event or other undesired application of force to the firearm. The drop/jar sensor system further generally will be designed to be omni-directional so as to be capable of sensing a jarring event or other application of force or acceleration in any direction, although it may be advantageous for the drop/jar sensor system 27 to exhibit greater or less sensitivity to force or acceleration in certain directions, such as along the barrel or bore of the firearm.

Figure 2B:
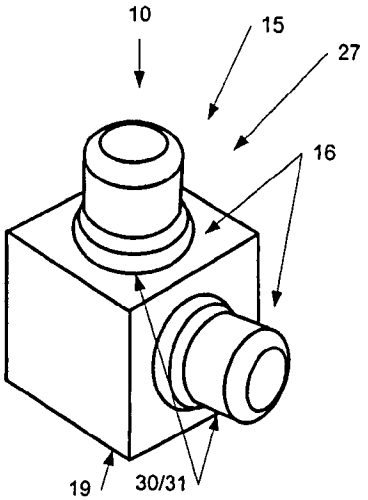
FIGS. 2A–2D are perspective illustrations illustrating various example embodiments of the mounting of a sensor to a mounting block for mounting the sensor or array of sensors to a firearm.
Figure 2D:
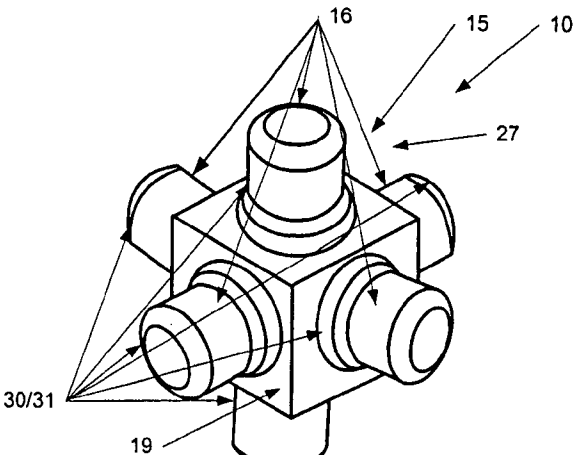
Figure 2A:
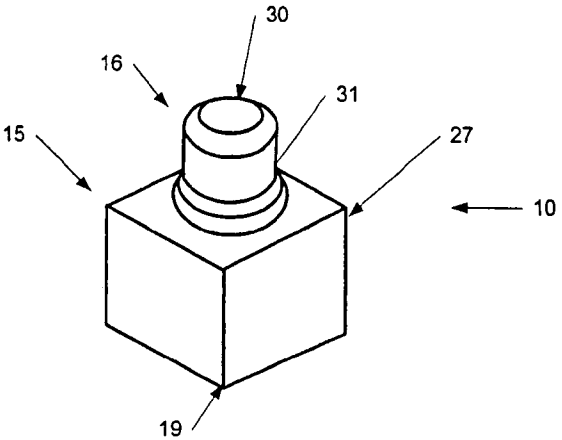
Figure 2C:
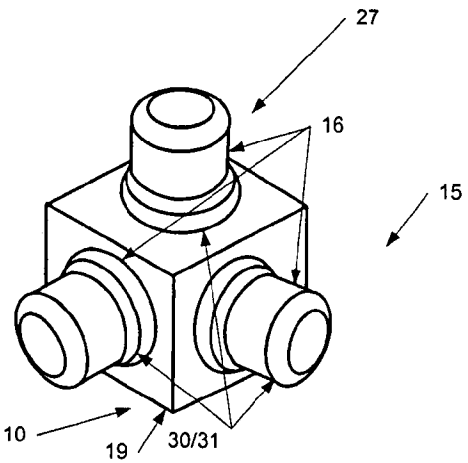

For detecting jarring forces and/or undue acceleration of the firearm, the sensors 16 of the drop/jar sensor system 27 generally will include one or more acceleration sensors 30 (FIGS. 2A–2D), such as inertia switches or acceleration switches 31 arranged in a variety of different configurations or sensor arrays 15 on a mounting block 19 as shown in FIGS. 2A–2D. One preferred embodiment of the drop/jar sensor system typically employs a series of uni-directional acceleration switches 31 arranged to form an omni-directional sensor, although other, multi directional type switches can be used, such as, for example, a one omni-directional acceleration switch 31 mounted on a mounting block 19, as shown in FIG. 2A. Alternatively, FIG. 2B shows a configuration of two planar acceleration switches 31 mounted on a mounting block 19 to produce an omni-directional system. Three orthogonally mounted uni-axial acceleration switches 31 shown in FIG. 2C provide an omni-directional sensing system. Any combination of acceleration switches that can be combined to produce an omni-directional sensing system can be used as a drop/jar sensing system. Six orthogonally mounted uni-directional switches 31 can be configured/mounted to form an omni-directional sensor as shown in FIG. 2D. However, other configurations of acceleration switches 31 are possible.

Additionally, the examples in FIGS. 2A–2D generally illustrate the use of a preferred minimum or near minimum number of acceleration switches needed to create an omni-directional sensor. However, it may be desirable to use more acceleration switches than shown above in some cases. As more switches are used, if properly oriented, the more consistent the acceleration/jar threshold level or range becomes regardless of the jarring or acceleration event direction. For example, the six uni-directional switches shown in FIG. 2D may not activate until the acceleration is about 173% of an activation level or threshold range of the acceleration switches 31. This occurs when the acceleration event occurs in a direction that is about 54.74 degrees from the nearest three acceleration switch directions. For example, better omni-directional performance and sensitivity is obtained with an increased number of properly oriented sensors being used.

Inertia or acceleration switches are available with normally open or normally closed contacts. Normally closed contacts generally are preferred because it takes less time for the normally closed contacts to open than it does for normally open contacts to close, although other types of switches also can be used. Normally closed contacts are opened as the firearm is subjected to a jarring force and/or acceleration sufficient to cause a contact or contacts of the switches to separate or open. The inertia or acceleration switches further can be wired in series so as to function as single switch such that if any of the inertia or acceleration switches is opened as a result of an acceleration or jarring force being detected that exceeds a predetermined acceleration switch 31 threshold, the sensor array will indicate a fault condition. If normally open switches are used, the switches can be wired in parallel to work as one switch. Six orthogonally mounted uni-directional switches can be configured to make an omni directional sensor as shown in FIG. 2D.

Momentary contact acceleration switches further generally are preferred such as, for example, a Select Controls, Inc. extended TO-18 configuration acceleration switch, which can be custom built with any activation level from about 0.5 to 10,000 G's. The activation level of the acceleration switches used sets the threshold level of acceleration. To change the desired threshold level of acceleration requires that new acceleration switches with the desired activation level should be used. Typical handling of firearms produces accelerations of less than eight G's. A typical long gun being dropped from a height of approximately one inch onto a one inch rubber mat typically produces accelerations in excess of fifteen G's. Based on this information, a preferred threshold level or range of acceleration required for activation can be set at about ten G's. The threshold level is however, arbitrary and should be set to be higher than levels that would occur during normal handling and lower than any event that could cause a false trigger, and will further vary based on firearm platform and/or uses. The acceleration associated with acquiring moving targets can be minimized by locating the acceleration switches in the stock close to the recoil pad as shown in FIG. 1A.

Figure 2F:
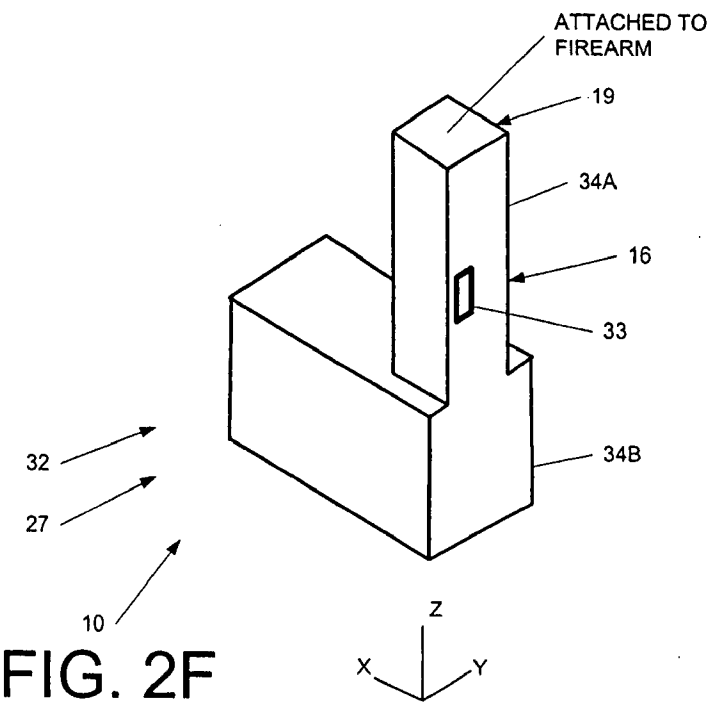
FIGS. 2F–2H are perspective illustrations of an additional embodiment of the present invention illustrating various examples cantilevered mass jar sensors.
Figure 2E:
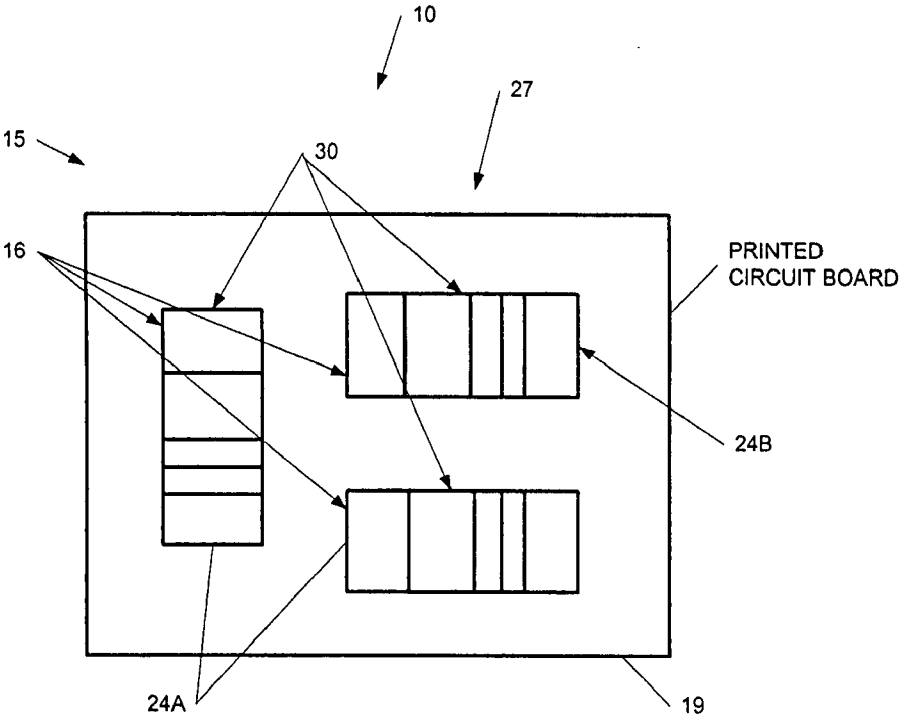
FIG. 2E is a perspective illustration of an array of piezoelectric shock sensors mounted on a printed circuit board.

It further will be understood that while inertia switches or acceleration switches are disclosed for use in the present invention, they are not the only technology that can be used with the drop/jar sensor system 27 (FIGS. 2E–2H) to detect a fault condition such as the firearm being subjected to undue acceleration or a jarring or force event so as to prevent the firearm from accidentally being discharged. Other sensors or sensing systems that also could be used could include accelerometers or a system or arrays of accelerometers, piezo-electric shock sensors, such as Murata PKGS shock sensors, electrolytic tilt sensors, as well as other types of contact switches. For example, FIG. 2E illustrates a drop/jar sensor system 27—using two Murata PKGS-00LC shock sensors 24A and one PKGS-90LC shock sensor 24B oriented on a printed circuit board to function as an omni-directional drop/jar sensing system.

Figure 2H:
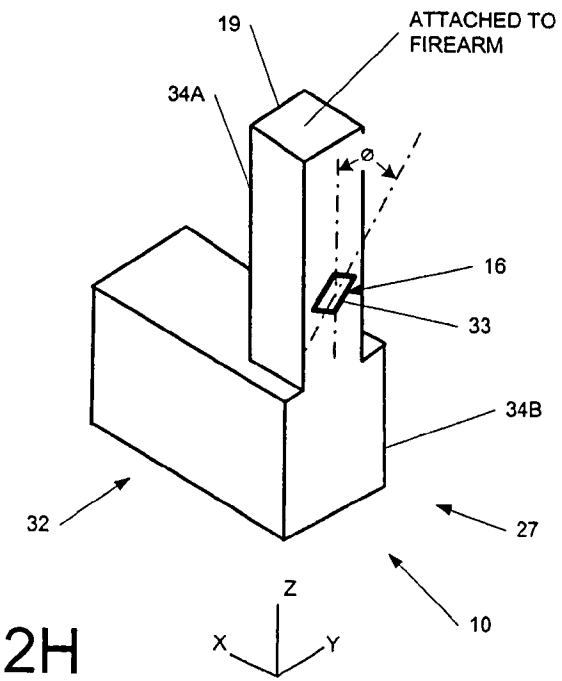
Figure 2G:
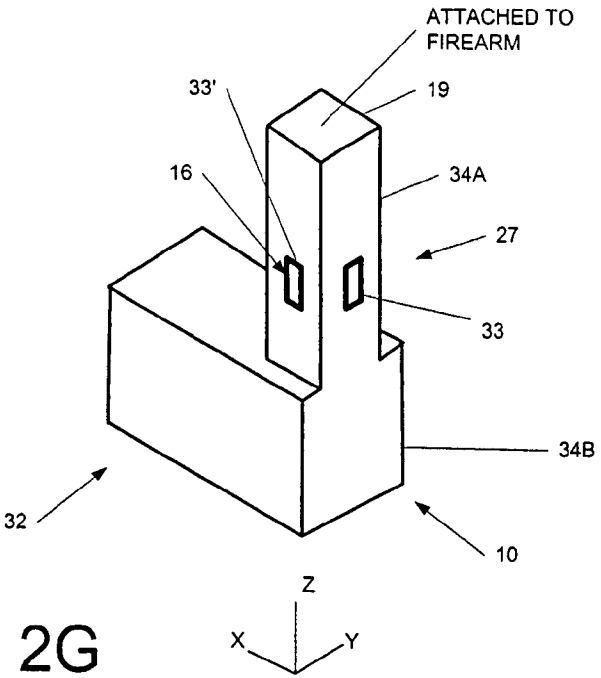

In addition, it will be understood by those skilled in the art that various other types of sensors as known in the art that can be made to sense and/or distinguish acceleration or application of force resulting from unnecessary, rapid acceleration or a jarring of a firearm, also can be used as part of the firearm sensor system 10 of the present invention for stopping or blocking the firing sequence of the firearm to prevent inadvertent discharge. It would also be possible to use a mass suspended from a cantilevered beam, such as mounted within the receiver or frame of the firearm, or the firearm stock, which has a strain gauge or other force sensor or detector mounted thereon as shown in FIGS. 2F–2H. Thus, as the firearm is subjected to a jarring event or acceleration, the movement of the mass in response to such a jarring or acceleration would tend to create a strain along a cantilevered beam. The strain would be detected by the strain gauge, which in turn would indicate or provide a signal indicating a fault condition.

FIGS. 2F–2H illustrate various example embodiments of a drop/jar sensor system 27" cantilevered mass jar sensor 32 that employs a strain gauge 33 mounted on a cantilevered beam 34A having a mass 34B mounted thereto to sense any jarring events. If a sensor were made with only one strain gauge 33, it generally will be necessary to mount the strain gauge in non-centered aligned orientation, as shown in FIG. 2F, or at an angle, as shown in FIG. 2H, on the cantilevered beam 34A to sense a jarring event in any direction. Typically, the sensitivity to "Y" direction (assuming the strain gauge is mounted on either of the "Y-Z" surfaces of the cantilevered beam 34A) jarring events would be less than that in the "X" and "Z" directions. FIG. 2G illustrates a cantilevered mass jar sensor that uses two strain gauges 33 and 33 to sense jarring events. "Y" direction jarring event sensitivity is provided by a strain gauge mounted on a "X-Z" surface of the cantilevered beam. The use of two or more strain gauges may be dictated by the width of the cantilevered beam 34A being too narrow to mount a strain gauge 33/33' sufficiently off-center, or based upon the need for more sensitivity to jarring events in the multiple directions. The cantilevered mass sensor configurations illustrated in FIGS. 2F–2H give only three possible configurations, but those skilled in the art will understand that many more, different configurations are possible.

Figure 3A:
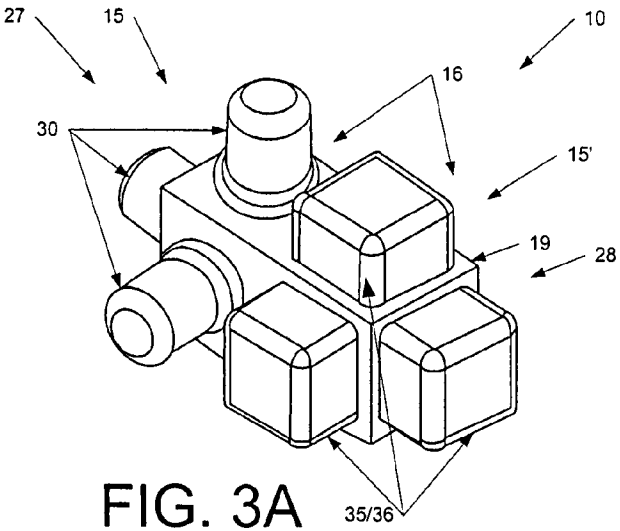
FIGS. 3A–3B are a perspective illustrations of a sensor array for measuring the jarring and/or orientation of the firearm.
Figure 3B:
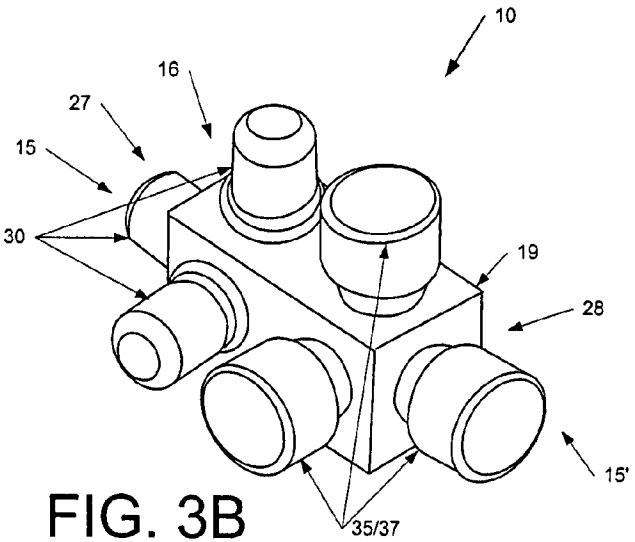
Figure 4:
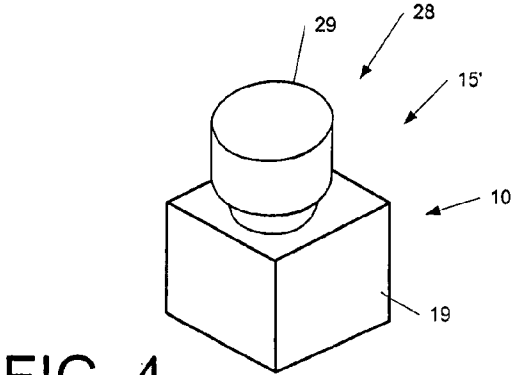
FIG. 4 is a perspective illustration of a further example embodiment of a sensor array for detecting an undesired orientation of a firearm.
Figure 5:
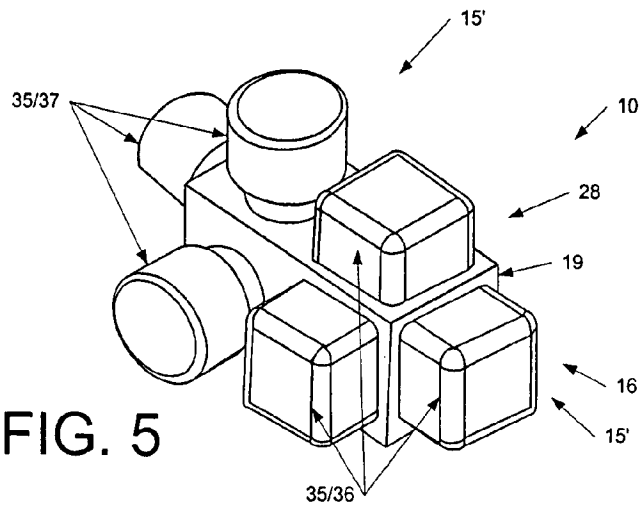
FIG. 5 is a perspective view illustrating a sensor array for use in detecting and monitoring the orientation of the firearm.

In addition, or in the alternative, the firearm sensor system 10 of the present invention can further include an orientation sensor system 28 in which the sensor arrays 15' include a series of orientation sensors 35 arranged in an array so as to be capable of measuring or sensing the orientation of the firearm along two or more axes relative to the earth. Typically, such an orientation sensor array 15' will include magnetometers 36, as shown in FIG. 3A, angular rate sensors 37, as shown in FIG. 3B, tilt or tip-over switches 29 as shown in FIG. 4, or can include a combination of magnetometers, angular rate sensors, or similar sensors as shown in FIG. 5. Other types of sensors, however, also can be used for sensing the orientation of the firearm, including inclinometers, accelerometers, gyros and/or other similar types of sensors capable of detecting the angle of orientation of a firearm with respect to one or more predefined axes. The orientation sensors 35 typically will be oriented or arranged in a sensor array 15' similar in configuration or design to the array 15 of the acceleration sensors 30 (FIGS. 2A–3B). Typically, the orientation sensors 35 are mounted to the mounting block 19 in an arrangement adjacent the acceleration sensors 30, and thereafter will be mounted via the mounting block onto or within the firearm, as indicated in FIGS. 1A and 1B.

The array of orientation sensors 35 generally will measure the orientation of the firearm in terms of its angle relative to at least two predetermined axes relative to the earth. The first axis of measurement generally is the inclination or elevation of the firearm with respect to the earth. The second axis of measurement generally will include what shooters typically refer to as "cant", which is equivalent to the firearm being rotated about an axis 38 extending along the bore of the firearm barrel 39. The orientation sensors 35 can be set with a predetermined threshold range or limit, such as in the context of using tilt or tip-over switches 29 as shown in FIG. 4, or can provide a sensor signal indicating the measured angle of degree of displacement of the firearm with respect to the predefined axis. This reading or measurement is used by the control system 25 to determine if the firearm is in an acceptable firing orientation. If not, the control system will issue an interrupt signal cause the interruption or blocking of the firing sequence of the firearm.

An example of a preferred orientation sensor 35 would include the Applied Physics Systems Model 544 Miniature Angular Orientation Sensor. The Model 544 uses a three axis fluxgate magnetometer and a three axis accelerometer to sense orientation. The Model 544 is also equipped with an analog to digital converter and microprocessor subsystem. The microprocessor processes the raw signals from the accelerometer and fluxgate magnetometer into a 16 bit digital signal that represents the inclination, cant, and azimuth orientation angles. In addition, the Model 544 should be isolated from the shock induced by recoil of the firearm such as by mounting the sensor to the firearm with a shock absorbing material. Examples of suitable shock absorbing materials include rubber, neoprene, styrene and other, similar lightweight dampening or shock absorbing materials.

The azimuth angle of orientation is equivalent to the angle one would get from reading a compass, and is not necessarily required for the operation of the sensor system. The inclination angle of orientation is the angle between the earth and axis of the barrel. Zero inclination generally is defined by the barrel of the firearm being horizontal and the trigger being located below the axis of the barrel. The inclination angle increases as the muzzle end of the barrel is raised relative to the opposite end. The cant orientation angle is a measure of the firearm's angled rotation about the axis of the barrel. The cant angle is equal to zero when the trigger is directly below the axis of the barrel. A clockwise rotation about the axis of the barrel when viewed from the butt stock end causes the angle to increase.

The threshold limits for orientation sensor system 28 are arbitrary and depend on the intended use of the firearm. For example, the expected safe operating orientations of a shotgun used for upland bird hunting typically will be different than those expected for centerfire rifle used to hunt deer, and different still for most handgun use. A preferred inclination operating range for a shotgun is from approximately negative 90 degrees to approximately positive 90 degrees. A centerfire rifle preferred inclination operating range is from about negative 90 degrees to about positive 45 degrees. A preferred cant operating range for both shotguns and rifles generally is from about negative 45 degrees to about positive 45 degrees. These operating ranges can be further varied as needed depending on the type of firearm (i.e., rifle, shotgun, or handgun) and its intended environments/uses.

It will also be understood that the present invention is not limited only to the use of an Applied Physics Systems Model 544, but rather that various other, alternative sensors also can be used as discussed above with their outputs processed into an orientation signal, including the use of three-axis fluxgate magnetometers and three-axis accelerometers as separate individual components. The signals generated by the magnetometer and accelerometer are sent to a controller or processor 40 of the control system 25 to be processed into cant, inclination, and azimuth orientation angles. The three-axis magnetometer can include a single unit or can consist of three orthogonally mounted single axis magnetometers. Similarly, the three-axis accelerometer may consist of three single axis accelerometers orthogonally mounted.

Figure 6A:
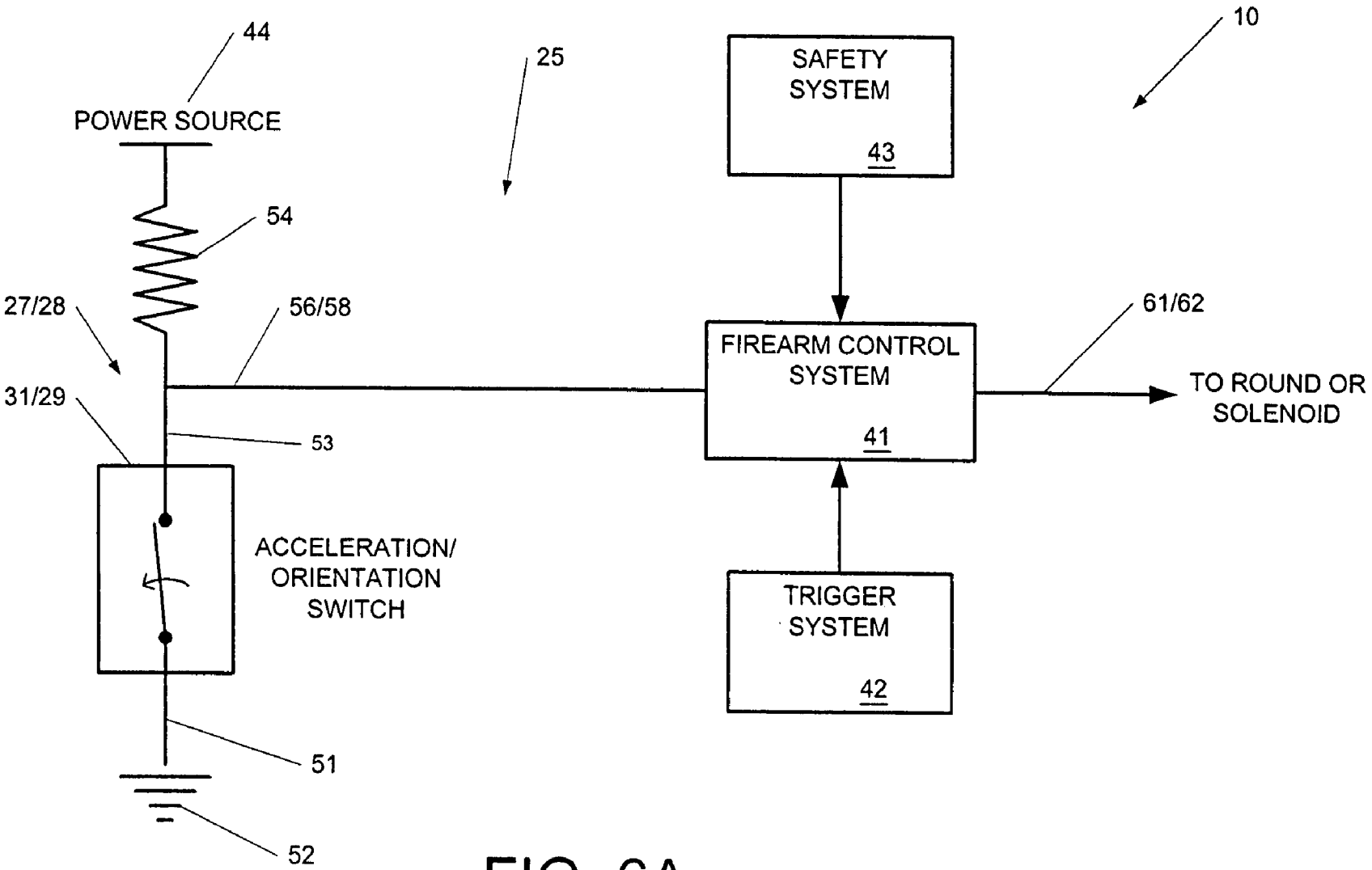
FIGS. 6A–6F are schematic illustrations of different example embodiments of the control system of the sensor system of the present invention.
Figure 6B:
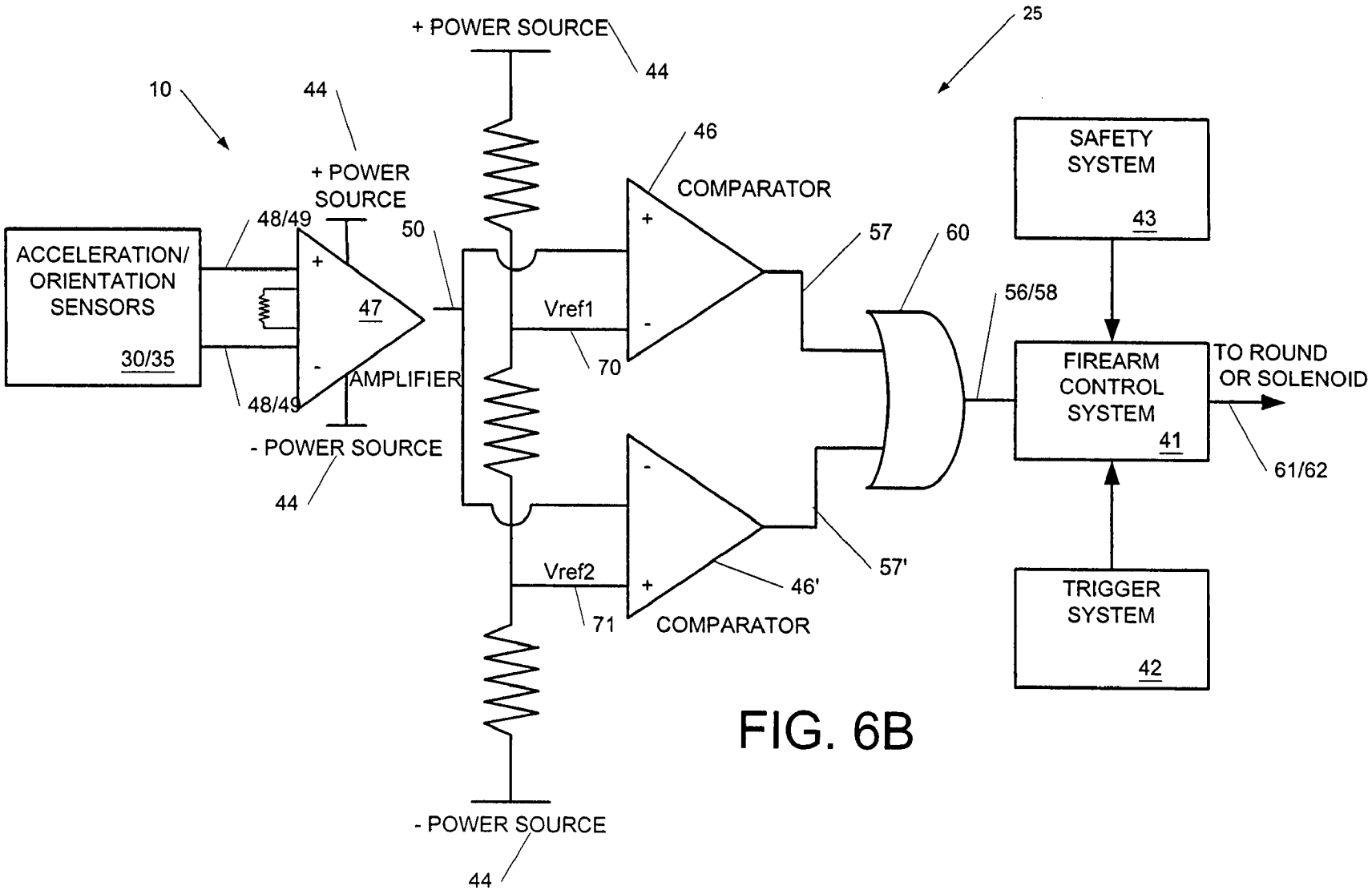
Figure 6C:
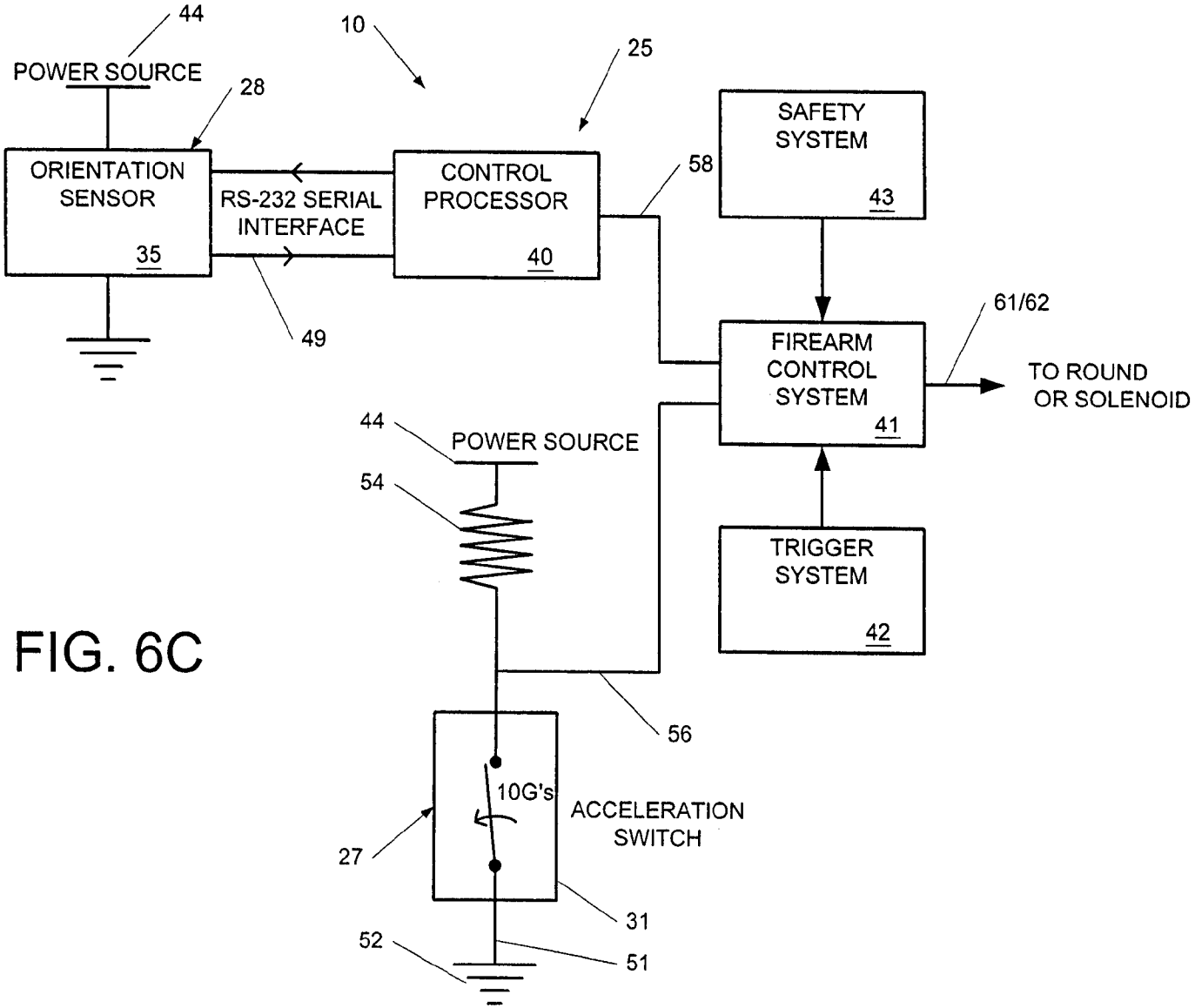

The orientation or jar/drop sensors or sensing technologies used also can be either analog or binary in nature. Tilt or tip-over switches 29 are an example of a binary sensor. FIG. 6A illustrates an example embodiment of a control system 25 that can be used when binary orientation or acceleration switches are used. Some examples of alternative analog orientation sensors include electrolytic inclinometers, accelerometers, and gyros. FIGS. 6B and 6E illustrate example embodiments of control systems 25 for use with analog orientation or acceleration sensors.

Preferably, the firearm sensor system 10 of the present invention will prevent or block the completion of a firing sequence of the firearm so that the firearm is kept from firing if the firearm has experienced a jarring or force event or undue acceleration, and/or is in an improper or unsafe orientation. It will, however, be understood that the firearm sensor system 10 of the present invention does not need to monitor both conditions in order to act to prevent the firing of the firearm. In further embodiments of the invention, it is possible that the firearm sensor system could be used to sense only acceleration or a jarring event acting on the firearm to stop the firing sequence, or alternatively, the firearm sensor system could be designed to sense and stop or block the firing sequence of the firearm when the firearm is simply moved into an undesired or unsafe orientation.

Figure 6D:
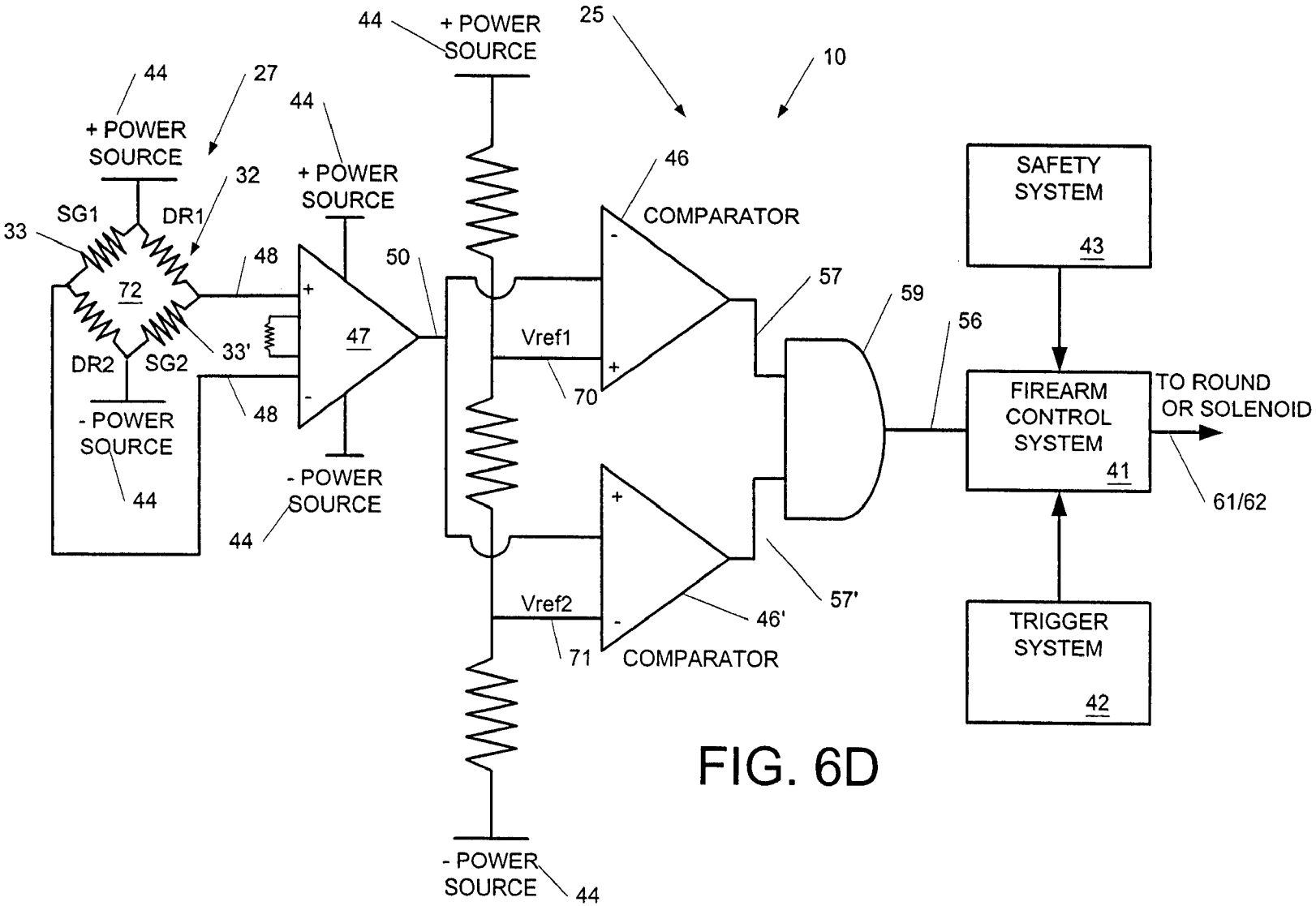
Figure 6E:
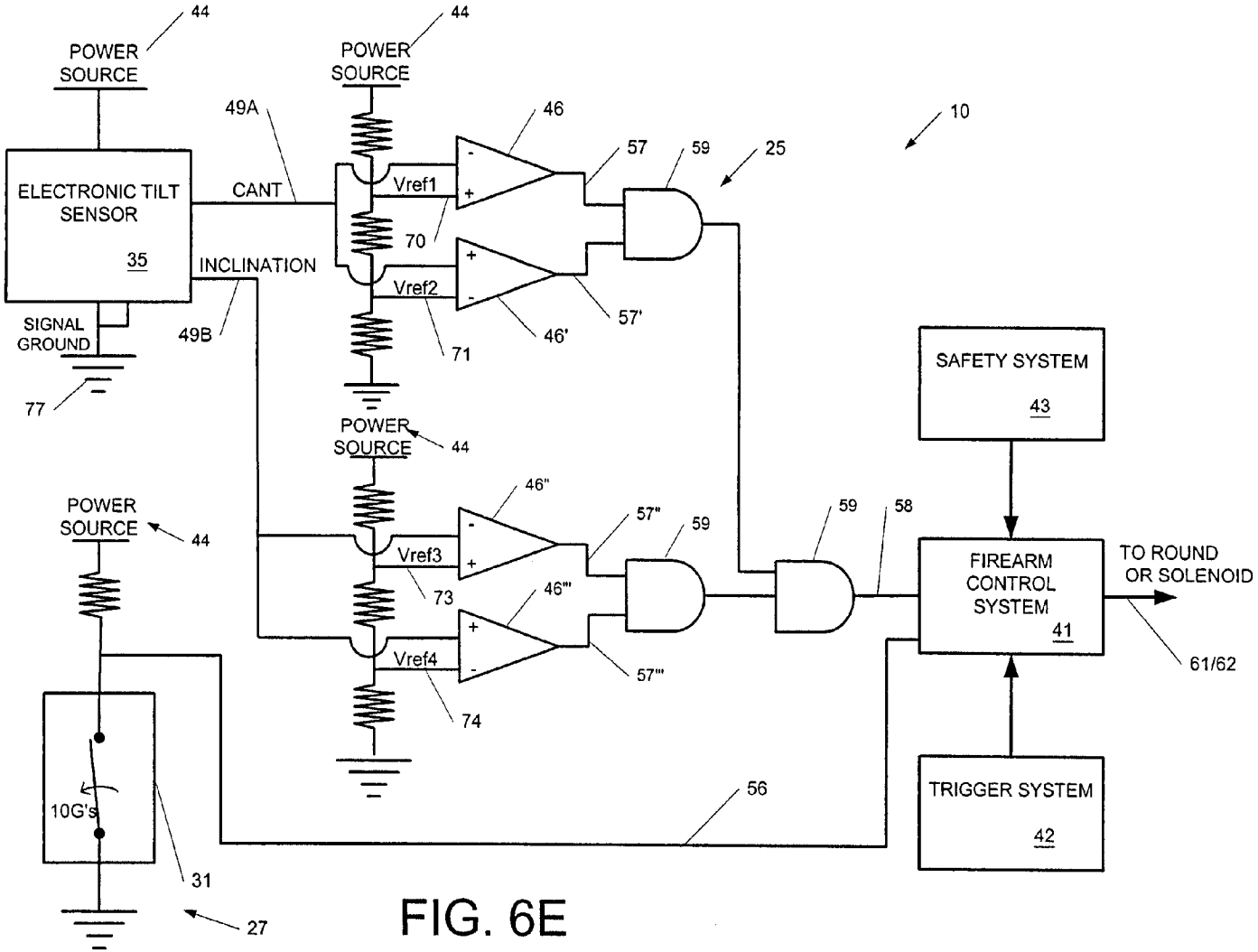

FIGS. 6A–6F illustrate alternative embodiments of the control system 25 of the firearm sensor system of the present invention. As shown in each embodiment the control system 25 generally includes a firearm control system 41, which typically is a microprocessor or micro-controller, but also could include discrete digital logic, discrete analog logic, and/or custom integrated logic or a similar type of control system and can be a separate processor or can be included as part of or programmed into the processor of an electronic firearm as disclosed in U.S. Pat. No. 5,755,056. The control system 25 further generally includes a trigger system 42 for controlling the initiation and firing of a round of ammunition from the firearm, a safety system 43 to stop or block the initiation and firing of a round of ammunition, and at least one power source 44. As shown in FIGS. 6B, 6D, and 6E the control system can also include one or more comparators 46. As shown in FIGS. 6B and 6D, the control system 25 also can include a precision instrumentation amplifier 47 for receiving and amplifying a sensor signal, such as a jar sensor signal 48 (FIGS. 6B and 6D) or orientation signal 49 (FIGS. 6B, 6C, 6E, and 6F) communicated from the acceleration and/or orientation sensors 30 and 35 (FIG. 6B) of the firearm sensor system 10, and generating an amplified sensor signal 50.

The control system 25 (FIG. 6B) can be embodied as a separate controller for the firearm and can be used in both mechanically and electronically operated firearms. It also will be understood by those skilled in the art that the control system of the present invention further can be included as a part of an overall firearm control system, such as the electronic system controller of an electronic firearm, that fires electrically actuated ammunition, such as disclosed in U.S. Pat. No. 5,755,056, the disclosure of which is incorporated herein by reference. The control system thus can comprise software, firmware, microcode and/or other programmed logic or code that is included within the system controller for such an electronic firearm, and the power source 44 could thus be the same power source as for the electronic controller of the firearm. Further, as discussed more fully below, the firearm control system 41 can include an electronic control system for a firearm firing electronically actuated ammunition such as disclosed in U.S. Pat. No. 5,755,056, or can include an electromechanical system or application, such as using a solenoid or other actuator 68 (FIG. 1B) to engage and hold the firing pin 23 in a ready, non-fire position to prevent it from striking, and thus initiating the firing of a percussion primed round of ammunition 67.

FIG. 6A illustrates one example preferred embodiment of the control system 25 of the sensor system 10 of the present invention, in which the array of acceleration switches 31 are wired in series as represented by the Acceleration/Orientation Switch 31/29. One lead 51 of the series of acceleration switches 31 is connected to ground 52. A second lead 53 is connected in series with a resistor 54 to power source 44 and to the firearm control system 41. When the normally closed acceleration switch experiences an acceleration beyond the activation level of the switch it opens. When the switch opens the voltage of the jar occurred signal 56 that is connected to the firearm control system 41 goes from a binary low to a binary high. When this happens the firearm control system 41 recognizes a jar event has occurred. The firearm control system 41 stops or blocks the firing sequence of the firearm. The firing sequence of the firearm can be stopped or blocked for a predetermined amount of time or until the condition is cleared by the operator. One possible means of the operator clearing the condition is to cycle the safety of the safety system 43. To avoid false interrupts, the jar occurred signal 56 can be ignored for a desired delay, such as, for example, 200 ms, after initiating a round of ammunition to allow for the recoil event.

Typically, as illustrated in FIG. 6A upon sensing a acceleration or orientation beyond the threshold limit, the binary acceleration or orientation switches 31/29 of the drop/jar or orientation sensor system will provide a true illegal orientation signal 58 or jar occurred signal 56 to the firearm control system 41 to indicate a fault condition. For example, as illustrated in FIG. 6A, if inertia or acceleration switches are used, with the switch or switches being normally closed, upon a jarring or acceleration event beyond the switches activation level, the switch or switches will be caused to open, causing the signal communicated to the firearm control system 41 to go high. The firearm control system 41 will recognize this as a fault and block the firing sequence from occurring.

In addition, as illustrated in FIG. 6B, the acceleration and/or orientation sensors used can include analog sensors that provide their sensor signal(s) to the precision instrumentation amplifier 47 that in turn generates an amplified analog sensor signal 50 that will be communicated to a comparator 46 and/or 46. The comparators compare the amplified sensor signal with a programmed or selected reference signal and generate output signals 57/57' that generally are combined into one sensor output signals 56/58 by OR logic gate 60, which signal is transmitted to the firearm control system 41 for processing to determine whether or not it is safe to initiate a round of ammunition.

The output signal(s) 57/57' from the comparator(s) can be a false signal, which is where the threshold reference signal exceeds the sensor signal, thus indicating that the firearm is in a safe to fire condition, or it can be a true signal such as where the sensor signal exceeds the threshold reference signal so as to indicate to the firearm control system 41 that a fault condition has been detected by the sensor array. The threshold reference can be set at a predetermined level, or can be set at a zero value such that any signal received from the sensor array that is in excess of a zero voltage level would indicate a fault condition. By setting the level of the threshold reference signal, the system can be set for greater or lesser sensitivity to jarring, acceleration events, and/or improper orientations.

The threshold reference signals also can be set at variable levels so that an acceptable amount of movement or jarring of the firearm would be permitted, which generally would be significantly less than a level sufficient to cause the firearm to discharge, such as during normal handling and aiming of the firearm to prevent a shutdown of the system and blocking of the firing sequence of the firearm under inappropriate circumstances. For example, in monitoring the inclination orientation angle of the firearm, the upper threshold reference could be set at a value or range somewhere in excess of 90–135° from a horizontal axis relative to the earth, although greater or lesser threshold angles can be set as desired, such that as the shooter is tracking a shot, such as a bird flying overhead, the firearm will not be inadvertently disabled, unless the firearm is moved into an unsafe orientation, such as being turned upside down or other undesirable orientation. Similarly, the threshold reference signals can be set to allow the firearm to be moved rapidly to a desired position for firing, such as when tracking a moving target, and still prevent an accidental discharge from ajar-off.

SAAMI (Sporting Arms and Ammunition Manufactures Institute) specifies that new rifles and shotguns must pass a jar-off test of dropping a ready to fire rifle or shotgun from a height of 12 inches onto a one inch rubber mat. Observed accelerations from doing this typically are several hundred Gs. Accelerations as high as eight G's have been observed in normal handling. A ten G acceleration threshold is suggested to provide the maximum amount of jar-off protection without interfering with the normal operation of the firearm. After receiving the output signal(s) from the comparator(s), the firearm control system will, in response, either issue a firing signal 61 to allow the firing sequence of the firearm to proceed or will prohibit the firing sequence from proceeding. Thus, if the firearm sensor system detects that the firearm has been dropped or experienced some other jarring or force event or misorientation of the firearm, the firearm control system 41 (FIG. 6C) will receive the output signal and will accordingly stop the firing sequence from proceeding and initiating the firing of a round of ammunition within the chamber of the firearm.

For example, when an electronic firearm firing electrically primed or actuated ammunition, upon receipt of a trigger signal, the firing sequence of the firearm will proceed, such as disclosed in U.S. Pat. No. 5,755,056, which is incorporated herein by reference, wherein the system controller of the electronic firearm will direct a firing pulse or charge through an electrically conductive firing pin or probe 23 (FIG. 1A) to an electrically actuated primer for a round of ammunition 65 to ignite and thus fire the round of ammunition. If, however, the acceleration and/or orientation sensors of the sensor system of the present invention detects either that the firearm has been subjected to a jarring or other acceleration event that exceeds a predetermined level, and/or the firearm has been moved into an undesirable or unsafe orientation, or that the firearm has been moved at an unsafe angular rate, the firearm control system 41 of the sensor control system 25, in response to the indication of such a fault condition, will interrupt or otherwise signal a fault to the electronic firearm in order to block the transmission of the electrical firing pulse to the firing pin and thus to the round of ammunition. If the firearm control system 41 is part of the overall system controller for the electronic firearm, the electronic firearm can simply shut down or cancel the transmission of the firing pulse to the round of ammunition and instead shunt the built up firing pulse or charge to a ground.

It also will be understood by those skilled in the art that the sensor system of the present invention also can be used in a conventional firearm used for firing percussion-primed ammunition 66 (FIG. 1B). In such firearms, such as indicated in FIG. 1B, the firing pin 23 generally is spring biased toward and strikes the round of ammunition 66 to fire the round. A solenoid 68, piezo electric actuator, or other mechanically actuated safety or actuator engagement system can be mounted within the frame or receiver of the firearm and generally will include an extensible pin or rod that can engage a notch formed in the firing pin 23 or can engage a sear 69 that engages the firing pin to hold the firing pin in a non-fire or non-operative condition or state. This prevents the firing pin from being moved forwardly by its spring so as to strike and thus initiate the percussion primer of the round of ammunition. When the firearm control system 41 receives an output signal indicating that a fault condition has been detected by the sensors, i.e., that the firearm has been subjected to undue force or jarring, and/or that it has been moved into an undesirable orientation, the firearm control system 41 will interrupt or block the transmission of an electrical signal to the actuator, such as a solenoid, to stop the solenoid from releasing the firing pin and preventing an inadvertent or unintended discharge of the firearm.

FIG. 6B illustrates the use of an analog sensor to sense orientation or drop/jar events. For example, this embodiment of the control system shows how a shock sensor, such as a Murata PKGS sensor, could be used to sense drop/jar events. Such a shock sensor generally does not require a power supply to generate a sensor signal because the jar/sensor signal 48 is generated by a piezoelectric element. The sensor signal 48/49 is amplified by a precision instrumentation amplifier 47. The amplified sensor signal 50 is sent to comparators 46/46 to compare the signal to the lower and upper threshold or reference values 70 and 71. If the amplified sensor signal 50 is greater than Vref1 (70) or less than Vref2 (71) a true illegal sensor output signal 56/58 will be sent to the firearm control system 41 which will stop the initiation of the firing sequence if the trigger of the trigger system 42 is pulled.

This embodiment of the control system 25 only shows the use of one shock sensor, but it will be understood that additional axes of drop/jar detection can be added by the addition of additional properly oriented shock sensor, a precision instrumentation amplifier 47, and two threshold references or signals and comparators for each additional axis. A total of three axes generally would be sufficient to sense any drop/jar event. However, drop/jar events that do not occur aligned with one of the axes can require a higher acceleration to occur before sensing a drop/jar event. The worst case occurs when the direction of the jar event is about 54.74 degrees from each of the three orthogonal axes. This worst-case condition requires that 17.32 G drop/jar event to occur to initiate a 10 G threshold in any of the three axes. This could be addressed by processing the three shock sensor signals into one common signal that represents the total magnitude of the drop/jar event. However, this is not needed as long as the threshold reference level is sufficiently lower than the level of acceleration selected that will cause ajar induced trigger signal to be created.

FIG. 6D illustrates another example embodiment of the control system 25 for use with a drop/jar sensor system 27 that uses strain gauged cantilevered mass as the sensor. In this example embodiment, the strain gauge(s) 33, 33' are placed in a wheatstone bridge circuit 72. The first strain gauge (33) SG1 when unstrained should match in resistance to the first dummy resistor DR1. If a second strain gauge (33) SG2 is used, when unstrained, it should match in resistance with the second dummy resistor DR2. If a second strain gauge is not used the second and third dummy resistors should match in resistance. If the dummy resistors DR1 and DR2 further generally are matched in resistance, the output voltage signal (sensor signal 48) of the wheatstone bridge will be equal to zero when no strain is applied to the strain gauges. The output voltage signal 50 of the wheatstone bridge 72 is amplified by the precision instrumentation amplifier 47. The amplified signal 50 is sent to comparators 46/46 which compare it to voltage threshold reference signals 70 (Vref1) and 71 (Vref2). The voltage of Vref1 represents the upper boundary of the safe operating range of the amplified signal and Vref2 represents the lower boundary of the safe operating range. If the amplified signal is between threshold reference signals Vref2 and Vref1, the system generally determines that no jar event has occurred and it is safe to initiate the firing of the round of ammunition. However, if the amplified signal 50 is greater than Vref1 (threshold reference signal 70) or less than Vref2 (threshold reference signal 71) the control system determines that a jar event has occurred, and the firearm control system 41 blocks the generation of a firing pulse signal.

FIG. 6E illustrates a further example embodiment of the control system 25, wherein the orientation sensor 35 of orientation sensor system 28 includes an electrolytic tilt sensor, an example of which is the Advanced Orientations Systems, Inc. DX-045 unit mounted on an EZ-Tilt-3000 module. When the orientation sensor is in a position of zero degrees of cant and inclination, the cant and inclination signals, indicated by 49A and 49B, generally will be about one half of the voltage of a power source 44. As the inclination angle increases, the signal 49B increases until the signal equals the power source voltage at approximately 90 degrees of inclination. If the inclination decreases to approximately −90 degrees, the inclination signal will be equal to zero volts. The same relationship between the inclination signal and angle of inclination also is true for the cant signal and angle. Comparators are used to check to see if the cant and inclination angles of orientation are beyond the lower or upper threshold reference ranges/values 70/71 and 73/74. If cant signal is greater than Vref1 threshold reference signal (70), the inclination signal 49B is greater than threshold reference signal Vref3 (73), the cant signal 49A is less than Vref2 (71), or the inclination signal 49B is less than threshold reference signal Vref4 (74) a true illegal orientation signal 58 will be sent to the firearm control system 41.

Figure 6F:
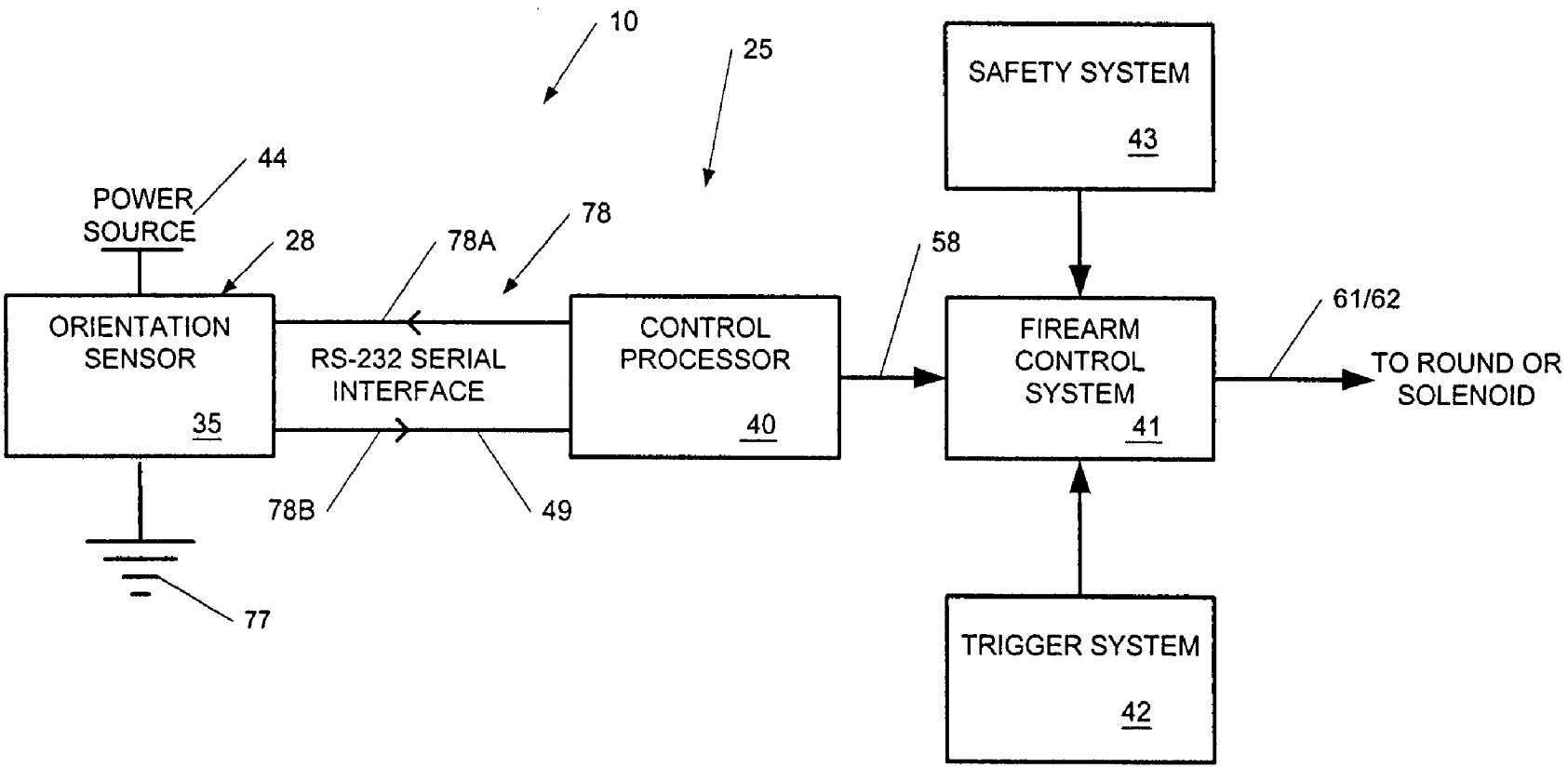

FIG. 6F is a schematic block diagram of the control system 25 for sensing firearm orientation. Power source 44 provides power to an orientation sensor 35, such as an Applied Physics Systems Model 544 angular orientation sensor, and can be either a +5 V supply or a +7–12 V supply depending on what type power cable is used. The sensor unit or array is also connected to a ground 77. The orientation sensor 35 communicates with the control system via a RS-232 serial interface 78. The interface is achieved via two wires one (78A) for input and one for output (78B). The orientation sensor 35 is also capable of communicating with the control system 25 via other connections or systems, such as a TTL serial interface or other, similar interface, which generally would also consist of one input and one output wire. The control processor 40 monitors the inclination and cant orientation angles reported by the orientation sensor, and if the inclination or cant angles of orientation are not within a safe range, the control system 25 produces a true illegal orientation signal.

The control processor 40 of the control system 25 also generally requests orientation information from the orientation sensor. If the cant and inclination orientation angles are within normal safe operating range the control processor 40 produces a false illegal orientation signal 58 and the firearm control system 41 generates the firing signal or pulse or energizes the solenoid as indicated at 61/62. If either the cant or inclination orientation angles are outside the normal safe operating range the control processor 40 produces a true illegal orientation signal and the firearm control system 41 prohibits the generation of a firing pulse or de-energizes the solenoid. This embodiment of the control system typically would only block the firing pulse or signal from being generated while either the cant or inclination angles are out of the normally safe operating range. It is also possible to block the generation of the firing pulse or signal after the illegal orientation signal has been received until the user has cleared the error through cycling the safety, battery removal and reinsertion, reset button, or the like. The illegal orientation generally is only checked upon the trigger system 42 signaling that the trigger has been pulled. The firearm control system 41 will ignore any illegal orientation signals received during the recoil event associated with actually firing a round. This will be achieved by neglecting the illegal orientation signal for a desired delay, for example, 200 ms, after initiating a round of ammunition.

Figure 7A:
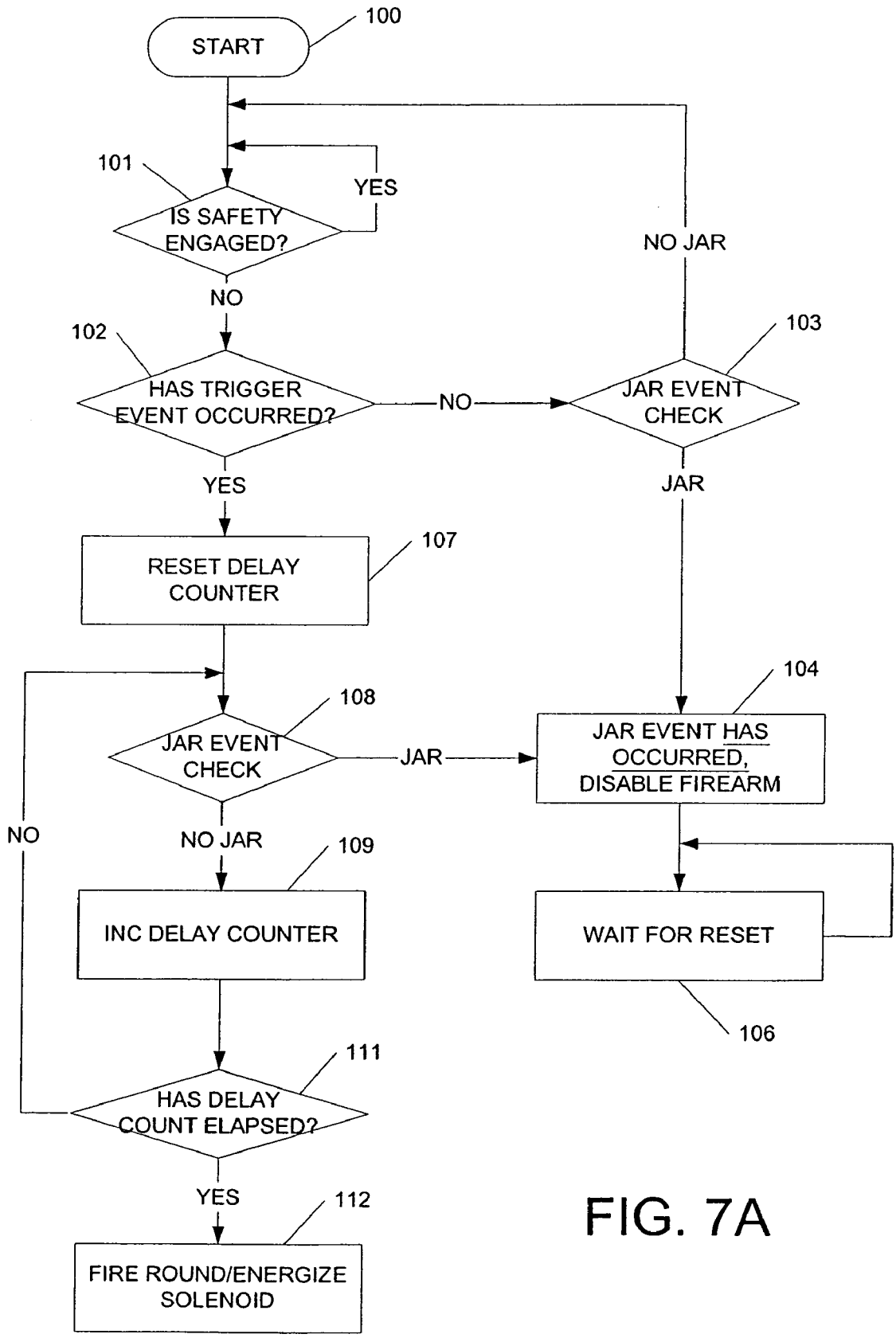
FIGS. 7A–7D are flow charts illustrating various embodiments of the operational methodologies of example control systems of the present invention.

FIGS. 7A–7D are flowcharts illustrating example operational steps or embodiments of the control systems 25 (FIGS. 6A–6F) of the present invention. FIG. 7A illustrates an example of a control system that senses drop/jar events. Upon the start (100) of an operational sequence, the control system checks to see if a firearm safety mechanism is engaged in an initial step 101. If the safety is engaged, the control system continues to periodically check to see if the safety is engaged. If the safety is not engaged, the control system then checks to see if a trigger event has occurred, as indicated at 102. If a trigger event has not occurred, the control system next checks to see if a jar event has occurred as shown at 103. If a jar event has occurred, the firearm is disabled as indicated at 104, and thereafter the firearm must be reset (106). If no jar event has occurred or is detected in step 103, the control system operational sequence or process returns to the beginning and checks again to see if the safety is engaged. Once the control system senses that a trigger event has occurred, a delay counter is reset at step 107. The control system also continues to check to see if a jar event has occurred until such an event is sensed or the delay time has elapsed as shown at blocks 108–111. If the delay time elapses without a jar event occurring, the control system sends a firing signal or pulse, indicated at 112, to initiate the firing of the round of ammunition or to operate a solenoid or actuator to enable movement of the firing pin.

The delay time typically is chosen so that a delay in the jar sensors signaling that a jar event has occurred will not allow a jar induced trigger signal to fire a round of ammunition. Testing of acceleration switches, such as the Select Controls Inc. 3088-1-000, has indicated an average of 0.64 milliseconds of delay between an acceleration event and the acceleration switch signaling the event. The greatest observed delay in the acceleration switch signaling the acceleration event was about 1.0 millisecond. As the magnitude of acceleration of the jar event increases, the delay time between the jar event and acceleration switch signaling the event decreases. It also appears that the activation level of the acceleration switches is sufficiently low as to generally require a considerable increase in magnitude of acceleration of the jar event before there is a risk of a jar induced trigger event. Based on this information it is suggested that the delay time be set at approximately one millisecond, although greater or lesser delay times also can be used depending on the types of sensors used and applications of the firearm(s).

Figure 7B:
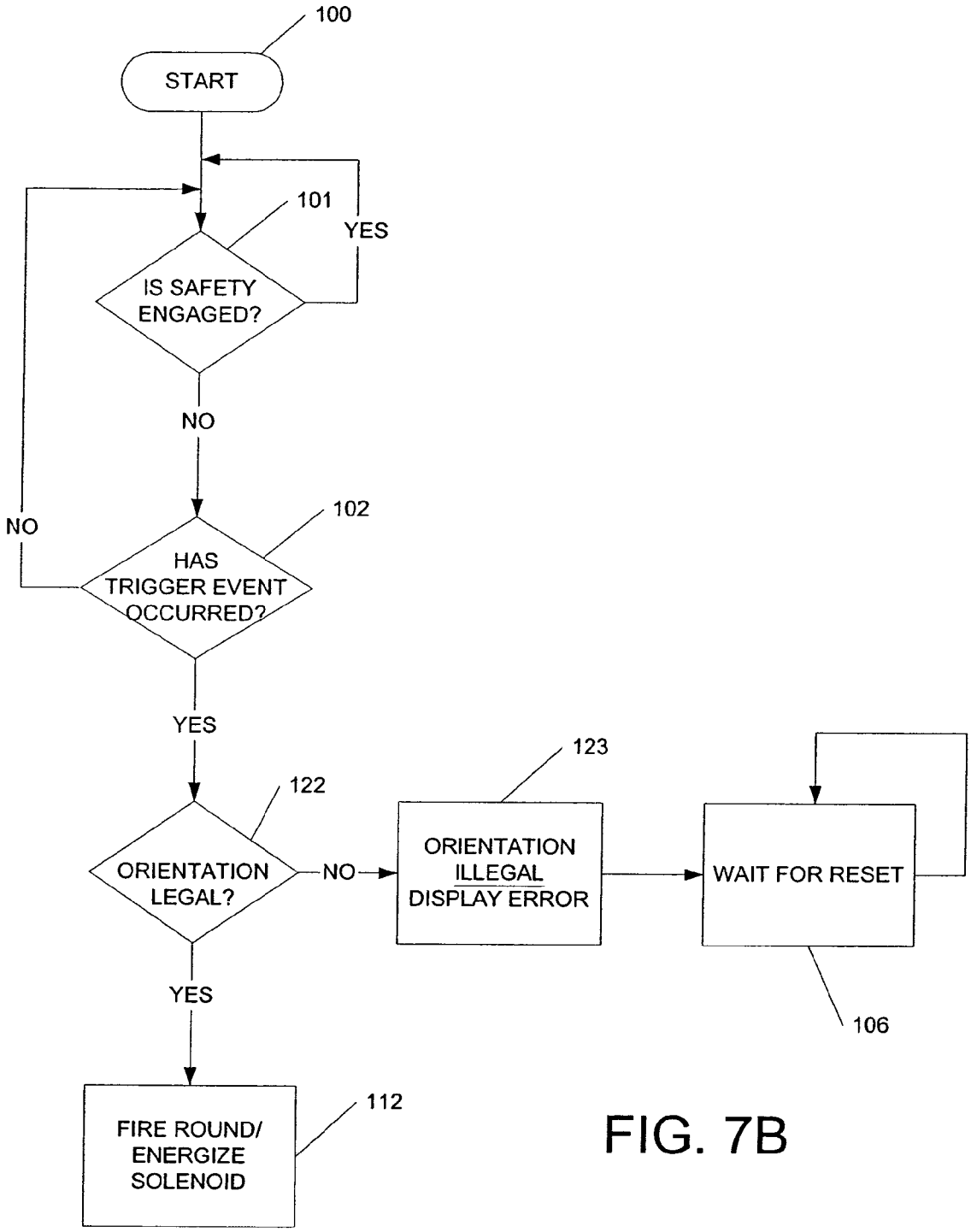

FIG. 7B is a flowchart showing another example control system that senses improper orientations. This embodiment/example control system also requires that the safety be disengaged prior to checking for a trigger event in step 102. Once the safety is found not engaged, the control system checks to see if a trigger event (102) has occurred until a trigger event does occur. The control system then will check the orientation sensor system, as indicated at 122, to see if the firearm is in a legal orientation. If it is not, an error is displayed (step 123) and the round is not fired and the firearm is disabled until reset as shown at 106. If the firearm is in a legal orientation, a firing signal or pulse is sent to initiate or allow initiation (i.e., striking of the round by the firing pin) of the firing of the round of ammunition as indicated at 112. This embodiment of the firearm control system does not require a delay time because illegal orientation does not induce false triggers, but rather triggers can be inadvertently pulled while in an illegal orientation.

Figure 7C:
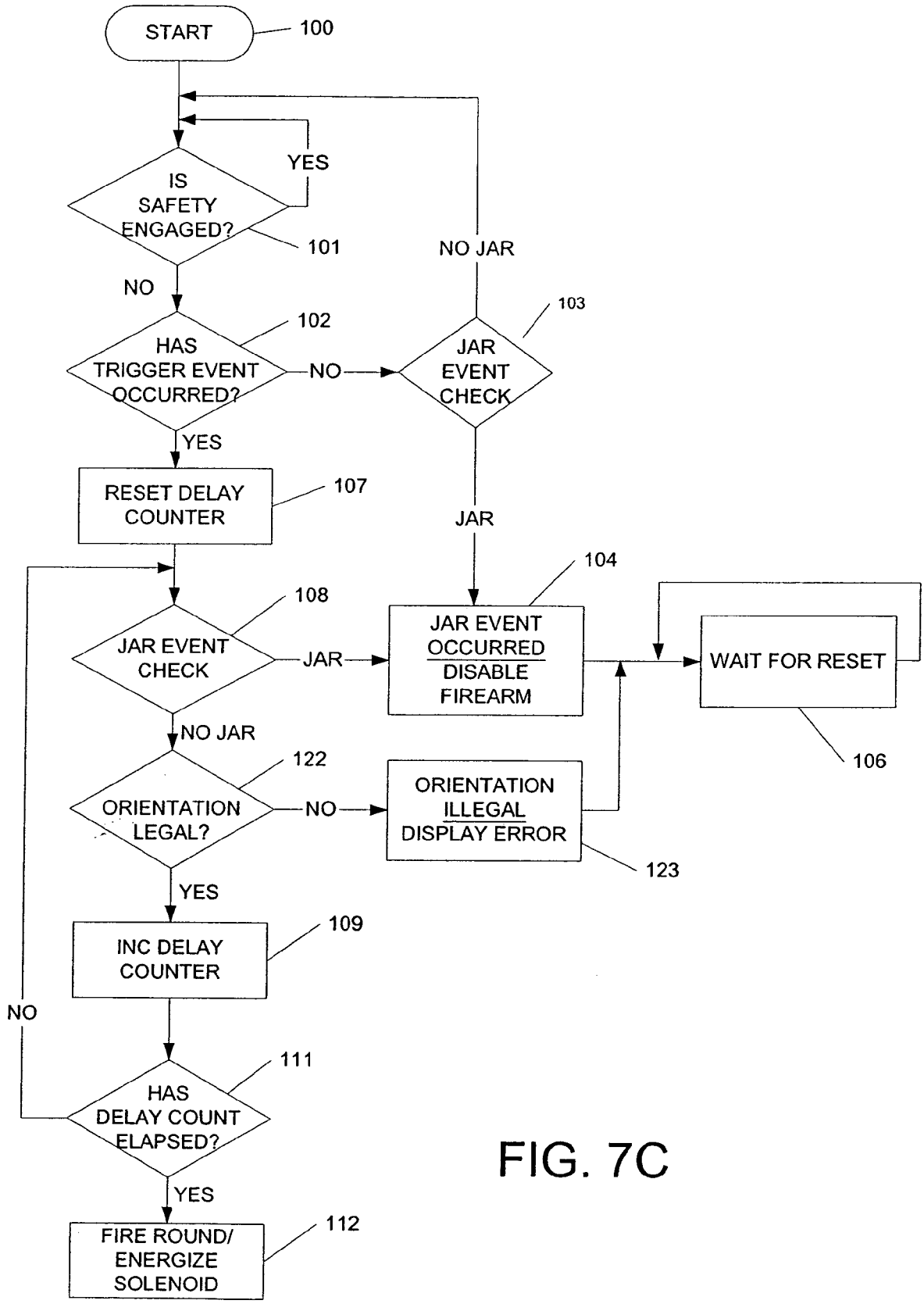

FIG. 7C is an example control system that utilizes both jar and orientation sensing systems. The control system operates in substantially the same fashion as illustrated in FIG. 7A except that it also checks the firearm orientation, indicated at step 122, every time it checks for a jar event after a trigger event (102) has been sensed and displays an error where an illegal orientation is detected, as shown at 123. This insures that the firearm remains in a legal orientation and no jar events occur during the delay time, after a trigger event has been sensed, before the firearm control system will allow the firearm to fire the round. An alternate embodiment would move the orientation detection outside the delay loop.

Figure 7D:
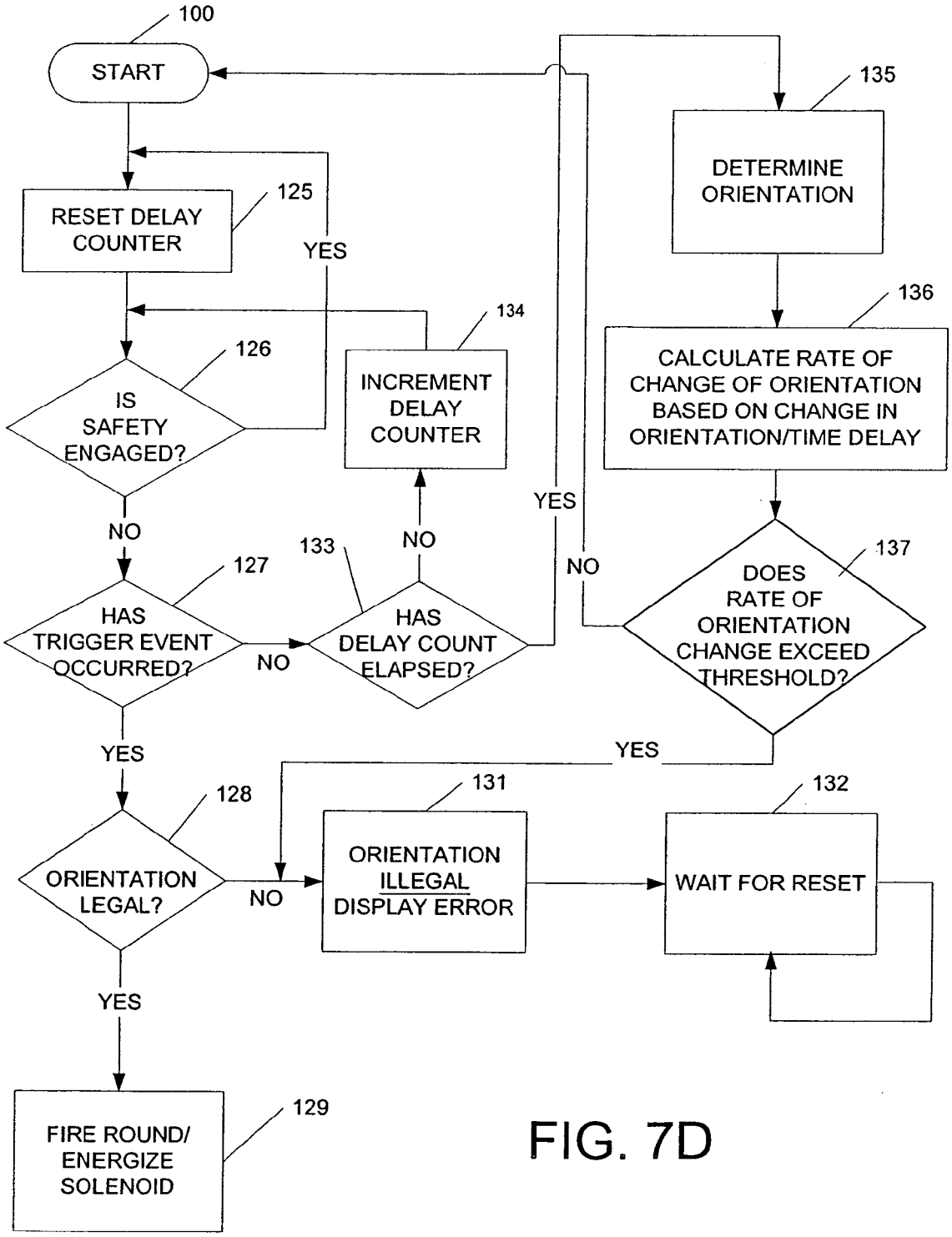

A further operational embodiment, as shown in FIG. 7D, would include monitoring the "rate of change" of the elevation and cant orientation signals. Further criteria would be established such that should the orientation of the firearm change at a rate exceeding a given threshold, the firearm would be disabled with or without a trigger event occurring. For example, a firearm being dropped from a hunting tree stand most likely will tumble at some rate prior to striking the ground. An arbitrary minimum threshold of about 180 degrees per second for a long gun, or greater for other firearm platforms such as shotguns or handguns, could be set. In many cases, the control system would detect the "tumble" in excess of this arbitrary rate and signal the control processor to disallow trigger inputs pending a cycle of the safety or other reset means.

The example control system of FIG. 7D generally uses a systematic polling of the firearm orientation to determine the rate of change of orientation. In operation of this control system, at least one orientation sensor is polled for position relative to elevation and/or cant on a periodic basis and the change in orientation is divided by the time between polling the sensor to determine an average rate of change of elevation and/or cant over the polling period. Should the average rate of change of either elevation or cant exceed a specified threshold the firearm is blocked from firing, the appropriate display error is posted, and the firearm then enters a state pending a reset event.

The control system begins by initially resetting a software based delay counter as indicated at 125, after which the firearm safety (step 126) is checked to determine whether the safety is engaged. If the safety is not engaged the control system then checks to see if a trigger event has occurred (step 127), and if so, a further check is made of the instantaneous orientation of the firearm, as shown at 128. If this orientation is acceptable the round is fired, as shown at 129, but if the orientation is found to be improper or unsafe, a fault condition is registered and an orientation illegal/error message or signal is provided as indicated at 131, after which the system generally must be reset (shown at 132) before continued operation.

If a trigger event (127) has not occurred a delay counter is examined to determine if the polling delay has elapsed as indicated at 133. If not, the sequence increments the delay counter (134) and returns to repeat the process beginning with checking the firearm safety (step 126). If the polling delay has elapsed, the current firearm orientation is obtained from the orientation sensor (elevation and/or cant) as shown at 135, and the change in movement measured or detected from the last polling is determined by subtracting the prior polling data from the most recent polling data, which measured change in movement is then divided by the polling delay time to determine the average rate of change of elevation (and/or the average rate of change of cant) as shown in step 136. These rates of change are then compared to stored or programmed rate of change thresholds to determine if the firearm has been "moved too rapidly" during the last polling period (step 137). If the rate of change does not exceed the threshold then processing continues at the operation start point with a reset of the polling delay counter (125) and the process or sequence of the system continues as above. If the rate of change exceeds the threshold then the firearm is disabled or otherwise blocked from firing, an appropriate display error is posted (131), and the firearm then enters an inactive or disabled state pending a reset event (step 132). The shorter the polling delay time, the better the resolution of rate of change detection and as such, the polling delay time generally should be set to be slightly greater than the acquisition time required by the orientation sensor itself, for example, typically about 130 to about 200 milliseconds.

It will be understood by those skilled in the art that while the present invention has been described above with reference to preferred and alternative embodiments, various modifications, additions and changes can be made to the present invention without departing from the spirit and scope of this invention as set forth in the following claims.

The invention claimed is:

1. A sensor system for a firearm including a barrel and a trigger, comprising:

a sensor array mounted to the firearm for detecting a fault condition and generating a sensor signal, wherein detecting the fault condition comprises sensing an undesired orientation of the firearm; and a control system receiving said sensor signal from said sensor array and determining whether an orientation angle determined by said sensor array is within a prescribed safe range, and stopping a firing sequence of the firearm upon detection of the fault condition;

wherein said control system produces a firing signal for enabling firing of the firearm if said orientation angle is within the prescribed safe range, and wherein the prescribed safe range is at least one of:

(a) an inclination orientation angle of from about negative 90 degrees to about positive 90 degrees, relative to an approximately horizontal axis; and (b) a cant orientation angle of from about negative 45 degrees to about positive 45 degrees, wherein said cant orientation angle is a measure of the rotation of the firearm about an axis defined by the barrel, wherein said cant orientation angle is zero when the trigger is below said axis defined by the barrel.

2. The system of claim 1 and wherein said sensor array includes at least one of the following: a magnetometer, angular rate sensor, tip-over switch, inclinometer, tilt switch, gyro, and accelerometer.

3. The system of claim 1 and wherein said sensor array includes at least one omni-directional sensor.

4. The system of claim 1 and wherein said control system includes a fire control, and a control processor.

5. The system of claim 4 and wherein said fire control includes an electrically conductive firing pin connected to a voltage supply for transmitting an electrical firing pulse to a round of ammunition for firing the round of ammunition.

6. The system of claim 4 and wherein said fire control includes a firing pin and a firing pin spring engaging and urging said firing pin toward engagement with a round of ammunition to fire the round of ammunition, wherein said firing pin is biased into contact with the round of ammunition by said firing pin spring to cause the firing of the round of ammunition.

7. The system of claim 1 and wherein said control system comprises a processor and a firearm control system controlled by said processor for actuating firing of a round of ammunition.

8. A system for controlling the firing of a round of ammunition by a firearm, comprising:

a sensor array mounted along the firearm;

said sensor array including at least one sensor capable of monitoring the orientation of the firearm along an axis relative to earth and generating a sensor signal indicative thereof; and a control system receiving said sensor signal and causing the firearm to be disabled when said sensor signal falls outside a prescribed operating safe range for the orientation of the firearm.

9. The system of claim 8 and wherein said at least one sensor comprises any one of the following: accelerometers, angular rate sensors, inertia switches, and magnetometers.

10. A system for controlling the firing of a round of ammunition by a firearm, comprising:

a sensor array mounted along the firearm, said sensor array including at least one sensor capable of monitoring the orientation of the firearm along an axis relative to earth and generating a sensor signal indicative thereof; and a control system receiving said sensor signal and causing the firearm to be disabled when said sensor signal falls outside a prescribed safe range for the orientation of the firearm, wherein the firearm includes a firing pin, moveable into engagement with a round of percussion primed ammunition to fire the round of ammunition.

11. A system for controlling the firing of a round of ammunition by a firearm, comprising:

a sensor array mounted along the firearm, said sensor array including at least one sensor capable of monitoring the orientation of the firearm during use of the firearm and generating a sensor signal indicative thereof; and a control system receiving said sensor signal and causing the firearm to be disabled when said sensor signal falls outside a prescribed safe range for the orientation of the firearm, wherein the firearm includes an electrically conductive firing pin connected to a voltage supply for transmitting an electrical firing pulse to a round of electrically primed ammunition for firing the round of ammunition when said sensor signal is within said prescribed safe range.

12. A firearm comprising:

a sensor system mounted to the firearm for sensing orientation of the firearm in an unsafe condition with respect to a prescribed axis relative to earth, or an unsafe change in orientation of the firearm relative to the earth, and generating a sensor signal indicating a fault condition; and a control system receiving said sensor signal from said sensor system and stopping a firing sequence of the firearm upon detection of said fault condition.

13. The firearm of claim 12 wherein said sensor system is omni-directional.

14. The firearm of claim 12 and wherein said sensor system includes an orientation sensor that generates a signal that is related to the orientation of the firearm in relation to the earth.

15. The firearm of claim 14 wherein said sensor system comprises any of the following; magnetometers, accelerometers, electrolytic tilt sensors, tilt or tip-over switches, angular rate sensors and shock sensors.

16. The firearm of claim 14 wherein said orientation sensor senses a single axis of angular orientation of the firearm relative to the earth.

17. The firearm of claim 16 wherein said sensor system comprises one or more electrolytic tilt sensors.

18. The firearm of claim 16 wherein said sensor system comprises one or more tilt or tip-over switches.

19. The firearm of claim 14 wherein said sensor system senses two orthogonal axes of angular orientation.

20. The firearm of claim 12 wherein said sensor system comprises at least one tilt or tip-over switch.

21. The firearm of claim 12 and wherein said control system includes a trigger system and a firearm control system.

22. A firearm comprising:

a sensor system mounted to the firearm for sensing orientation of the firearm in an unsafe condition, or an unsafe change in orientation of the firearm during use of the firearm, and generating a sensor signal indicating a fault condition; and a control system receiving said sensor signal from said sensor system and stopping a firing sequence of the firearm upon detection of the fault condition, wherein said control system includes a trigger system and a firearm control system, and wherein the firearm includes an electrically conductive firing pin connected to a voltage supply for transmitting an electrical firing pulse to a round of electrically primed ammunition for firing the round of ammunition.

23. A firearm comprising:

a sensor system mounted to the firearm for sensing orientation of the firearm in an unsafe condition along an axis relative to earth, or an unsafe change in orientation of the firearm along an axis relative to the earth, and generating a sensor signal indicating a fault condition; and a control system receiving said sensor signal from said sensor system and stopping a firing sequence of the firearm upon detection of said fault condition, wherein said control system includes a trigger system and a firearm control system, and wherein the firearm includes a firing pin, moveable into engagement with a round of percussion primed ammunition to fire the round of ammunition.

24. A firearm comprising:

a barrel and a trigger;

a sensor system mounted to the firearm for sensing orientation of the firearm;

a control processor in communication with the sensor system, the control processor for generating a sensor signal indicating a fault condition if the orientation of the firearm is not within a prescribed safe range; and a control system receiving the sensor signal from the control processor and preventing firing of the firearm upon detection of the fault condition;

wherein the prescribed safe range is at least one of:

(a) an inclination orientation angle of from about negative 90 degrees to about positive 90 degrees, wherein the inclination orientation angle is the angle between the earth and an axis of the barrel when the barrel is substantially horizontal with respect to earth; and (b) a cant orientation angle of from about negative 45 degrees to about positive 45 degrees, wherein the cant orientation angle is a measure of the rotation of the firearm about the axis of the barrel, the cant orientation angle is zero when the trigger being below the axis of the barrel.

* * * * *